US009984526B2

(12) United States Patent
Bartholomew et al.

(10) Patent No.: US 9,984,526 B2
(45) **Date of Patent: *May 29, 2018**

(54) AUTOMATED CUSTOMIZED COSMETIC DISPENSER

(71) Applicant: Cosmetic Technologies, L.L.C., West Bloomfield, MI (US)

(72) Inventors: Julie R. Bartholomew, Birmingham, MI (US); Kristopher Killen, Rochester Hills, MI (US); William M. Hunter, Macomb, MI (US); Michael E. Istok, Macomb, MI (US)

(73) Assignee: COSMETIC TECHNOLOGIES, L.L.C., West Bloomfield, MI (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/629,386

(22) Filed: Jun. 21, 2017

(65) Prior Publication Data

US 2017/0282139 A1 Oct. 5, 2017

Related U.S. Application Data

(60) Continuation of application No. 14/100,403, filed on Dec. 9, 2013, now Pat. No. 9,691,213, which is a continuation of application No. 13/469,574, filed on May 11, 2012, now Pat. No. 8,608,371, which is a continuation of application No. 12/613,156, filed on Nov. 5, 2009, now Pat. No. 8,186,872, which is a division of application No. 11/268,065, filed on Nov. 7, 2005, now Pat. No. 7,624,769.

(60) Provisional application No. 60/635,521, filed on Dec. 13, 2004, provisional application No. 60/635,412, filed on Dec. 10, 2004, provisional application No. 60/628,713, filed on Nov. 17, 2004, provisional application No. 60/625,923, filed on Nov. 8, 2004.

(51) Int. Cl.

| | |
|---|---|
| ***G07F 11/16*** | (2006.01) |
| ***G07F 13/06*** | (2006.01) |
| ***B01F 13/10*** | (2006.01) |
| ***G07F 11/56*** | (2006.01) |
| ***G07F 11/70*** | (2006.01) |
| ***B01F 15/00*** | (2006.01) |
| *B01F 11/00* | (2006.01) |
| *B01F 13/08* | (2006.01) |

(52) U.S. Cl.

CPC ..... *G07F 13/06* (2013.01); *B01F 13/1055* (2013.01); *B01F 13/1063* (2013.01); *B01F 13/1069* (2013.01); *B01F 13/1072* (2013.01); *B01F 15/00318* (2013.01); *G07F 11/165* (2013.01); *G07F 11/56* (2013.01); *G07F 11/70* (2013.01); *B01F 11/00* (2013.01); *B01F 13/08* (2013.01); *B01F 2215/0031* (2013.01)

(58) Field of Classification Search

CPC ..... G07F 11/165; G07F 13/06

See application file for complete search history.

(56) References Cited

U.S. PATENT DOCUMENTS

| | | | |
|---|---|---|---|
| 967,938 | A | 8/1910 | Krause |
| 1,912,899 | A | 6/1933 | Johannsen |
| D90,897 | S | 10/1933 | Rockola |
| D96,564 | S | 8/1935 | Simpkins |
| 2,393,371 | A | 1/1946 | Harris |
| 2,417,677 | A | 3/1947 | Cohan |
| D192,180 | S | 2/1962 | Hodgman |
| D192,301 | S | 2/1962 | Schaef |
| 3,024,583 | A | 3/1962 | Gastright |
| 3,471,611 | A | 10/1969 | Scott et al. |
| 3,527,236 | A | 9/1970 | Anthony et al. |
| 3,598,284 | A | 8/1971 | Wessely |
| 3,688,947 | A | 9/1972 | Reichenberger |
| 3,860,015 | A | 1/1975 | Tarro |
| 3,994,480 | A | 11/1976 | Fothergill et al. |
| D248,693 | S | 7/1978 | Housman |
| 4,133,525 | A | 1/1979 | Balles et al. |
| 4,160,271 | A | 7/1979 | Grayson et al. |
| 4,176,762 | A | 12/1979 | Scalera et al. |
| 4,351,591 | A | 9/1982 | Stockett |
| 4,434,467 | A | 2/1984 | Scott |
| 4,461,401 | A | 7/1984 | Sasnett, Jr. |
| 4,561,850 | A | 12/1985 | Fabbri et al. |
| 4,628,974 | A | 12/1986 | Meyer et al. |
| 4,681,546 | A | 7/1987 | Hart |
| 4,705,083 | A | 11/1987 | Rossetti |
| 4,720,025 | A | 1/1988 | Tatevosian et al. |

(Continued)

FOREIGN PATENT DOCUMENTS

| | | |
|---|---|---|
| CA | 98986 | 3/2003 |
| DE | 4110299 C1 | 2/1993 |

(Continued)

OTHER PUBLICATIONS

US 6,568,560, 05/2003, Bartholomew et al. (withdrawn)

Steve Inskeep, National Public Radio hosts about VinoVenue (a wine tasting bar in San Francisco, http://www.vinovenue.net/), National Public Radio, copyright 2004.

Website at www.reflect.com Published on May 4, 2001.

Website at www.threecustom.com copyright date 2001(accessed Jan. 25, 2002).

(Continued)

*Primary Examiner* — David Sorkin

(74) *Attorney, Agent, or Firm* — The Dobrusin Law Firm, P.C.

(57) ABSTRACT

The present invention provides a method and apparatus for the creation and dispensing of a custom formulation within a package at a retail point of sale. In one aspect, the invention includes an automated dispensing apparatus including at least a two-axis robot arm. In another aspect, the invention includes an automated mixer adapted to mix the dispensed custom formulation within the package.

20 Claims, 17 Drawing Sheets

(56) References Cited

U.S. PATENT DOCUMENTS

| | | | |
|---|---|---|---|
| 4,764,044 | A | 8/1988 | Konose |
| 4,830,218 | A | 5/1989 | Shirkan |
| 4,838,457 | A | 6/1989 | Swahl et al. |
| 4,846,184 | A | 7/1989 | Comment et al. |
| 4,871,262 | A | 10/1989 | Krauss et al. |
| 4,887,410 | A | 12/1989 | Gandini |
| D306,808 | S | 3/1990 | Thomas |
| 4,909,632 | A | 3/1990 | Simpson |
| 4,953,985 | A | 9/1990 | Miller |
| 4,966,205 | A | 10/1990 | Tanaka |
| 4,967,938 | A | 11/1990 | Hellenberg |
| 5,028,142 | A | 7/1991 | Ostoich et al. |
| 5,042,691 | A | 8/1991 | Maldonado |
| 5,044,520 | A | 9/1991 | Moisan |
| D322,542 | S | 12/1991 | Fontlladosa |
| 5,078,302 | A | 1/1992 | Hellenberg |
| 5,083,591 | A | 1/1992 | Edwards et al. |
| 5,111,855 | A | 5/1992 | Boeck et al. |
| 5,116,134 | A | 5/1992 | Edwards et al. |
| 5,119,973 | A | 6/1992 | Miller et al. |
| D327,695 | S | 7/1992 | Edstrom |
| D327,895 | S | 7/1992 | Edstrom |
| 5,137,367 | A | 8/1992 | Madonia et al. |
| 5,163,010 | A | 11/1992 | Klein |
| 5,163,484 | A | 11/1992 | Howlett et al. |
| 5,193,720 | A | 3/1993 | Mayberry |
| 5,197,802 | A | 3/1993 | Miller et al. |
| 5,203,387 | A | 4/1993 | Howlett et al. |
| 5,267,178 | A | 11/1993 | Berner |
| 5,267,669 | A | 12/1993 | Dixon et al. |
| 5,268,620 | A | 12/1993 | Hellenberg |
| 5,268,849 | A | 12/1993 | Howlett et al. |
| 5,271,527 | A | 12/1993 | Haber et al. |
| 5,271,628 | A | 12/1993 | Okada |
| 5,305,917 | A | 4/1994 | Miller et al. |
| 5,310,257 | A | 5/1994 | Altieri, Jr. et al. |
| 5,311,293 | A | 5/1994 | MacFarlane et al. |
| 5,312,240 | A | 5/1994 | Divone, Sr. et al. |
| 5,313,267 | A | 5/1994 | MacFarlane et al. |
| D347,645 | S | 6/1994 | Miller |
| D347,646 | S | 6/1994 | Mayberry |
| 5,328,057 | A | 7/1994 | Hellenberg et al. |
| D349,506 | S | 8/1994 | Caruso et al. |
| 5,356,041 | A | 10/1994 | Hellenberg |
| 5,361,812 | A | 11/1994 | Arneson et al. |
| 5,368,196 | A | 11/1994 | Hellenberg et al. |
| 5,379,916 | A | 1/1995 | Martindale et al. |
| 5,397,134 | A | 3/1995 | Fishman et al. |
| D357,142 | S | 4/1995 | Jones et al. |
| 5,407,100 | A | 4/1995 | Tracy et al. |
| 5,460,297 | A | 10/1995 | Shannon et al. |
| 5,478,238 | A | 12/1995 | Gourtou et al. |
| D366,304 | S | 1/1996 | Lewis |
| 5,480,288 | A | 1/1996 | Hellenberg et al. |
| 5,495,338 | A | 2/1996 | Gouriou et al. |
| 5,507,575 | A | 4/1996 | Rossetti |
| 5,524,656 | A | 6/1996 | Konarski et al. |
| 5,531,710 | A | 7/1996 | Dang et al. |
| 5,537,211 | A | 7/1996 | Dial |
| 5,549,372 | A | 8/1996 | Lewis |
| D374,677 | S | 10/1996 | Hodson et al. |
| 5,562,109 | A | 10/1996 | Tobiason |
| 5,562,643 | A | 10/1996 | Johnson |
| 5,566,693 | A | 10/1996 | Gunderman et al. |
| 5,612,868 | A | 3/1997 | Off et al. |
| 5,622,692 | A | 4/1997 | Rigg et al. |
| 5,626,155 | A | 5/1997 | Saute |
| 5,626,260 | A | 5/1997 | Waldner |
| 5,629,981 | A | 5/1997 | Nerlikar |
| 5,632,314 | A | 5/1997 | Koppe et al. |
| 5,636,637 | A | 6/1997 | Guiolet et al. |
| 5,643,341 | A | 7/1997 | Hirsch et al. |
| 5,647,411 | A | 7/1997 | Koppe et al. |
| 5,668,633 | A | 9/1997 | Cheetam et al. |
| 5,687,322 | A | 11/1997 | Deaton et al. |
| 5,690,252 | A | 11/1997 | Oleksiewicz et al. |
| 5,692,291 | A | 12/1997 | Deevi et al. |
| 5,697,527 | A | 12/1997 | Altieri, Jr. et al. |
| 5,711,458 | A | 1/1998 | Langeveld et al. |
| 5,711,601 | A | 1/1998 | Thomas et al. |
| 5,715,314 | A | 2/1998 | Payne et al. |
| 5,716,150 | A | 2/1998 | Gueret |
| 5,717,750 | A | 2/1998 | Adams, Jr. et al. |
| 5,720,017 | A | 2/1998 | Cheetam et al. |
| 5,724,424 | A | 3/1998 | Gifford |
| 5,730,330 | A | 3/1998 | Reading |
| D393,150 | S | 4/1998 | Swanston et al. |
| 5,771,524 | A | 6/1998 | Woods et al. |
| 5,778,901 | A | 7/1998 | Abrahamian |
| 5,785,510 | A | 7/1998 | Altieri, Jr. et al. |
| 5,785,960 | A | 7/1998 | Rigg et al. |
| 5,797,750 | A | 8/1998 | Gouriou et al. |
| 5,813,420 | A | 9/1998 | Sussman |
| D401,246 | S | 11/1998 | Langeveld et al. |
| 5,841,421 | A | 11/1998 | Cheetam et al. |
| 5,842,641 | A | 12/1998 | Mazzalveri |
| 5,860,809 | A | 1/1999 | Meehan |
| 5,862,947 | A | 1/1999 | Wiegner et al. |
| 5,867,403 | A | 2/1999 | Sasnett et al. |
| 5,897,204 | A | 4/1999 | Dittmer et al. |
| 5,903,465 | A | 5/1999 | Brown |
| 5,904,421 | A | 5/1999 | Mazzalveri |
| 5,906,433 | A | 5/1999 | Mazzalveri |
| 5,924,426 | A | 7/1999 | Galazin |
| 5,938,080 | A | 8/1999 | Haaser et al. |
| 5,944,227 | A | 8/1999 | Schroeder et al. |
| 5,945,112 | A | 8/1999 | Flynn et al. |
| 5,931,166 | A | 9/1999 | Weber et al. |
| 5,960,411 | A | 9/1999 | Hartman et al. |
| 5,971,351 | A | 10/1999 | Swaab |
| 5,972,322 | A | 10/1999 | Rath et al. |
| 5,933,792 | A | 11/1999 | Rath et al. |
| 5,982,501 | A | 11/1999 | Benz et al. |
| 5,984,146 | A | 11/1999 | Kaufman |
| 5,992,691 | A | 11/1999 | Post et al. |
| 5,993,792 | A | 11/1999 | Rath et al. |
| 6,000,407 | A | 12/1999 | Galazin |
| 6,002,488 | A | 12/1999 | Berg et al. |
| 6,003,731 | A | 12/1999 | Post et al. |
| 6,021,362 | A | 2/2000 | Maggard et al. |
| 6,035,860 | A | 3/2000 | Mombourquette |
| 6,035,867 | A | 3/2000 | Barrick |
| 6,056,158 | A | 5/2000 | Rossetti et al. |
| 6,065,969 | A | 5/2000 | Rifkin et al. |
| 6,073,834 | A | 6/2000 | Michael et al. |
| 6,089,538 | A | 7/2000 | Shirkhan |
| 6,095,677 | A | 8/2000 | Karkos et al. |
| 6,119,895 | A | 9/2000 | Fugere et al. |
| 6,121,878 | A | 9/2000 | Brady et al. |
| 6,139,429 | A | 10/2000 | Shoemaker, Jr. |
| 6,158,997 | A | 12/2000 | Post |
| 6,172,596 | B1 | 1/2001 | Cesar et al. |
| 6,177,093 | B1 | 1/2001 | Lombardi et al. |
| D437,151 | S | 2/2001 | Gerstmar |
| 6,182,555 | B1 | 2/2001 | Scheer et al. |
| 6,186,686 | B1 | 2/2001 | Neuner et al. |
| 6,198,536 | B1 | 3/2001 | Baker |
| 6,200,210 | B1 | 3/2001 | Pratt |
| 6,202,895 | B1 | 3/2001 | Fox |
| D442,405 | S | 5/2001 | Gerstmar |
| 6,264,786 | B1 | 7/2001 | Cromett |
| 6,270,273 | B1 | 8/2001 | Ohba |
| 6,273,298 | B1 | 8/2001 | Post |
| 6,293,284 | B1 | 9/2001 | Rigg |
| 6,297,420 | B1 | 10/2001 | Heincke |
| 6,318,596 | B1 | 11/2001 | Wiesner |
| 6,338,030 | B1 | 1/2002 | Senn et al. |
| 6,338,349 | B1 | 1/2002 | Robinson et al. |
| 6,371,129 | B1 | 4/2002 | Le Bras-Brown et al. |
| 6,382,269 | B1 | 5/2002 | Tatsuno |
| 6,383,542 | B1 | 5/2002 | Khodor et al. |
| 6,402,120 | B1 | 6/2002 | Swaab |
| 6,412,658 | B1 | 7/2002 | Bartholomew et al. |
| D461,080 | S | 8/2002 | Bartholomew et al. |

(56) References Cited

U.S. PATENT DOCUMENTS

| | | | | |
|---|---|---|---|---|
| D465,810 | S | 11/2002 | Bartholomew et al. | |
| 6,510,366 | B1 | 1/2003 | Murray et al. | |
| 6,516,245 | B1 | 2/2003 | Dirksing et al. | |
| 6,557,369 | B1 | 5/2003 | Phelps et al. | |
| 6,588,085 | B2 | 7/2003 | Holloway | |
| 6,607,100 | B2 | 8/2003 | Phelps et al. | |
| 6,615,881 | B2 | 9/2003 | Bartholomew et al. | |
| 6,622,064 | B2 | 9/2003 | Bartholomew et al. | |
| 6,663,818 | B2 | 12/2003 | Statham et al. | |
| D485,310 | S | 1/2004 | Bartholomew et al. | |
| 6,672,341 | B2 | 1/2004 | Bartholomew et al. | |
| 6,779,686 | B2 | 8/2004 | Bartholomew et al. | |
| 6,782,307 | B2 | 8/2004 | Wilmott et al. | |
| D500,804 | S | 1/2005 | Bartholomew | |
| 6,883,561 | B2 | 4/2005 | Bartholomew | |
| D513,040 | S | 12/2005 | Bartholomew et al. | |
| 7,082,970 | B2 | 8/2006 | Bartholomew et al. | |
| 7,099,740 | B2 | 8/2006 | Bartholomew et al. | |
| 7,121,429 | B2 | 10/2006 | Bartholomew et al. | |
| 7,134,573 | B2 | 11/2006 | Post | |
| 7,174,310 | B2 | 2/2007 | Bartholomew et al. | |
| 7,624,769 | B2 | 12/2009 | Bartholomew et al. | |
| 8,573,263 | B2 | 11/2013 | Bartholomew et al. | |
| 8,608,371 | B2 | 12/2013 | Bartholomew et al. | |
| 8,636,173 | B2 | 1/2014 | Bartholomew et al. | |
| 2001/0044579 | A1 | 11/2001 | Pratt | |
| 2002/0010528 | A1 | 1/2002 | Bartholomew et al. | |
| 2002/0084288 | A1 | 7/2002 | Lewis et al. | |
| 2002/0109270 | A1 | 8/2002 | Swaab | |
| 2002/0131985 | A1 | 9/2002 | Shana'a et al. | |
| 2002/0136700 | A1 | 9/2002 | Margosiak et al. | |
| 2003/0014324 | A1 | 1/2003 | Donovan et al. | |
| 2003/0060925 | A1* | 3/2003 | Bartholomew ..... | A45D 44/00 700/231 |
| 2003/0062379 | A1 | 4/2003 | Bartholomew | |
| 2003/0098314 | A1 | 5/2003 | Phelps et al. | |
| 2003/0151611 | A1 | 8/2003 | Turpin et al. | |
| 2004/0004309 | A1 | 1/2004 | Sears | |
| 2004/0122553 | A1 | 6/2004 | Phan et al. | |
| 2004/0243361 | A1 | 12/2004 | Steuben et al. | |
| 2006/0024342 | A1 | 2/2006 | Bartholomew et al. | |
| 2006/0043111 | A1 | 3/2006 | Jennings et al. | |
| 2006/0124196 | A1 | 6/2006 | Bartholomew et al. | |
| 2006/0283521 | A1 | 12/2006 | Bartholomew et al. | |
| 2007/0194038 | A1 | 8/2007 | Bartholomew et al. | |
| 2008/0047972 | A1 | 2/2008 | Bartholomew et al. | |

FOREIGN PATENT DOCUMENTS

| | | | |
|---|---|---|---|
| DE | 40202765.5 | | 3/2002 |
| EP | 0443741 | B1 | 8/1991 |
| EP | 0446512 | B1 | 1/1995 |
| EP | 0682236 | B1 | 11/1995 |
| EP | 0686997 | A2 | 12/1995 |
| EP | 0871022 | | 10/1998 |
| EP | 1093842 | | 4/2001 |
| EP | 3002418 | | 2/2003 |
| EP | 1429640 | | 3/2007 |
| EP | 1834309 | | 10/2013 |
| FR | 021986 | | 3/2002 |
| GB | 3002418 | | 3/2002 |
| GB | 2431577 | | 5/2007 |
| GR | 3062096 | | 6/2007 |
| JP | 04-231006 | | 8/1992 |
| JP | 05-025020 | | 2/1993 |
| JP | 05-107115 | | 4/1993 |
| JP | 05-233651 | | 9/1993 |
| JP | 07-243908 | | 9/1995 |
| JP | 07-270396 | | 10/1995 |
| JP | 08-050125 | | 2/1996 |
| JP | 08-280633 | | 10/1996 |
| JP | 09-10033 | | 1/1997 |
| JP | 09-038045 | | 2/1997 |
| JP | 09-133584 | | 5/1997 |
| JP | 09-178560 | | 7/1997 |
| JP | 10-339670 | | 12/1998 |
| JP | 11-169231 | | 6/1999 |
| JP | 11-218447 | | 8/1999 |
| JP | 11-265443 | | 9/1999 |
| JP | 2001-126140 | | 5/2001 |
| JP | 11-66435 | | 1/2003 |
| SU | 1704759 | | 1/1992 |
| WO | 95/05892 | | 3/1995 |
| WO | 98/05417 | | 2/1998 |
| WO | 98/30189 | | 7/1998 |
| WO | 99/34905 | | 7/1999 |
| WO | 99/61234 | | 12/1999 |
| WO | 01/12239 | | 2/2001 |
| WO | 01/91601 | | 6/2001 |
| WO | 01/75586 | | 10/2001 |
| WO | 01/91600 | | 12/2001 |
| WO | 0205200 | | 1/2002 |
| WO | 03/026458 | | 4/2003 |
| WO | 06/020189 | | 2/2006 |
| WO | 06/052863 | | 5/2006 |

OTHER PUBLICATIONS

Website at www.colorlab-cosmetics.com copyright date 2002 (accessed Jan. 25, 2002).
Pamphlet of Jovan, "Express your individuality." 2000.
Website at www.immedia.it—"Coty Introduces Jovan Individuality" pp. 1-3 (accessed Jun. 8, 2001).
Website at www.cpepkg.com, Issued on Jul./Aug. 2002.
Website at www.fast-fluid.com—"TiNTiA (hair dye dispenser" p. 2 (accessed May 18, 2004).
Information from www.cosmetics.com/custblnd.htm last updated on Oct. 1, 2001.
Evans, "An Introduction to Color", John Wiley & Sons, Inc, New York, 1948, pp. 87-90.
Wyszecki et al., "Color Science; Concepts and Methods, Quantitative Data and Formulae", 2nd Edition, A. Wiley Intescience Publication, Aug. 8, 2000 p. 63.
Cheskin, L. "Color Guide for Marketing Media", The MacMillan Co., 1954, pp. 133-140.
Lovett, P.A., et al., "Measurement of the Skin Colour of Babies in Hospital," National Lighting Conference 1986, pp. 140-154.
"The Shades of You; Your Color Palette," "Your New Image Through Color & Line", California Fashion Image, Crown Summit Books, 1981, pp. 1-3, 17, 21-29, 97-105, 111-112, and 120-127.
Shibatani, J., et al., "Measurements of Aging Effects of Facial Color Distribution and Applications," J. Soc. Cosmet. Chem. Japan, vol. 19 No. 1, 1985, pp. 48-52.
Website at www.idexcorp.com/groups/fluidmgt.asp—"Fluid Management" pp. 1-2 (accessed May 18, 2004).
Supplementary European Search Report dated Apr. 6, 2004.
Search Report dated May 23, 2003, PCT/US02/29515.
International Search Report for PCT/US2005/025384 dated Feb. 23, 2006.
International Search PCT/US2005/040240 dated Apr. 3, 2006.
European Search Report, EP Application No. 10 01 5814.6, dated Jun. 6, 2011.
EP Office Action for Serial No. 01 922 731.3-2307, Applicant IMX Labs, Inc. dated May 17, 2004.
EP Office Action for Serial No. 02 763 648.9-2313, Applicant IMX Labs, Inc. dated Jun. 6, 2005.
Co-pending PCT/US2013/66744, filed Oct. 25, 2013.

* cited by examiner

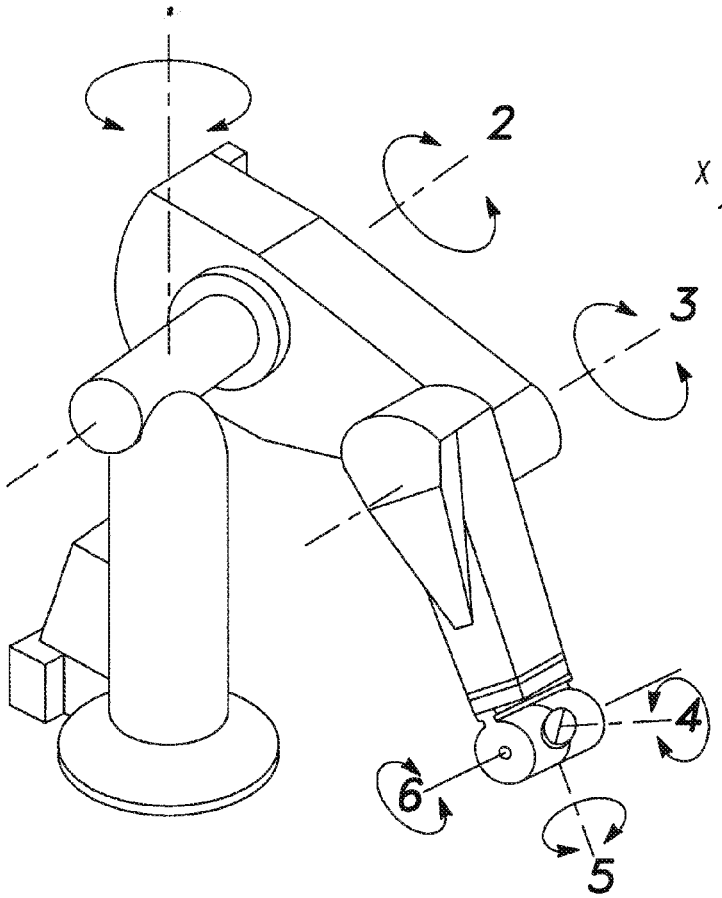
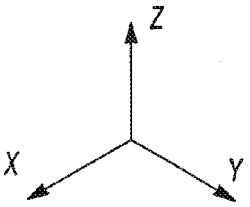
Fig-9A
Fig-9B
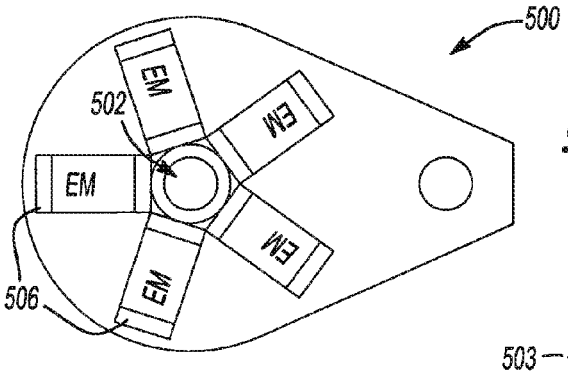
Fig-10A
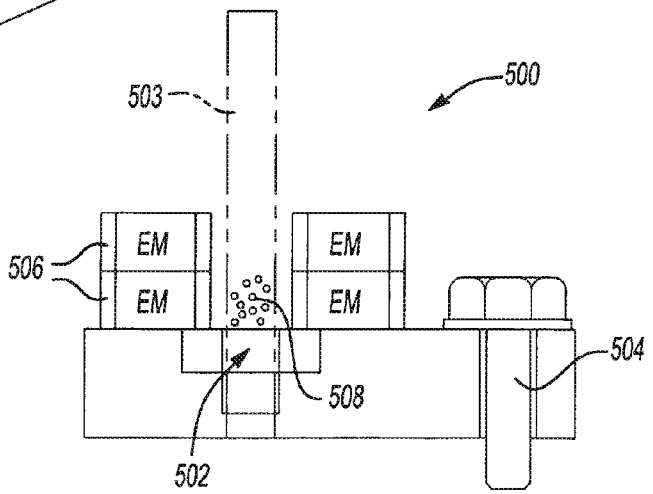
Fig-10B

AUTOMATED CUSTOMIZED COSMETIC DISPENSER

CLAIM OF PRIORITY

To the extent applicable, the present invention claims the benefit of the priority of U.S. Provisional Application Ser. Nos. 60/635,521, filed Dec. 13, 2004; 60/635,412, filed Dec. 10, 2004; 60/628,713, filed Nov. 17, 2004 and 60/625,923, filed Nov. 8, 2004, the contents of which are incorporated by reference herein.

TECHNICAL FIELD

The present invention relates to devices and methods for automated dispensing of customized personalized consumer products, particularly at a retail point of sale.

BACKGROUND OF THE INVENTION

The present invention relates generally to subject matter of previous commonly-owned applications and patents including U.S. Pat. Nos. 6,412,658; 6,622,064, 6,672,341; 6,615,881; D465,810; D461,080; 6,779,686; 6,883,561; D500,804 and D485,310 and Ser. No. 10/755,574 (filed Jan. 12, 2004), Ser. No. 10/848,273 (filed May 18, 2004), Ser. No. 10/274,514 (filed Oct. 18, 2002), 60/589,150 (filed Jul. 19, 2004) the contents of which are also incorporated by reference herein for all purposes.

As addressed in the above applications and patent, historically certain industries, such as the retail point of sale cosmetics industry, has afforded consumers a broad variety of choices for colors (including tones, shades or hues) and effects. In the typical scenario, these products are prepackaged according to a predetermined fixed amount of different colors or effects. The products are then ordinarily displayed to reveal a spectrum of a fixed number of colors. However, because of manufacturing and other practical limitations, point of sale displays only afford a finite number of selections for the consumer. Consequently, the consumer's choice of color will be limited by present availability or supply of a particular color choice, and also particularly by the specific colors chosen for sale in advance by the manufacturer. The consumer is afforded no practical opportunity to custom blend a color selection.

In view of the foregoing, a need has developed for a dispensing device and method adapted to provide customized product based upon user input, particularly employing a stand-alone apparatus at a retail point of sale, and even more particularly in a mass merchandising retail outlet, where real estate is typically scarce, it is difficult to permanently staff a dispensing apparatus with a technician for assisting a customer with a transaction, or both.

SUMMARY OF THE INVENTION

The present invention meets the above needs and provides a method and apparatus for dispensing a custom formulation, such as a custom cosmetic formulation, at a retail point of sale.

In one aspect, the method includes the steps of providing at a retail store a point-of-sale custom formulation dispensing apparatus, including a plurality of ingredients containers and packages for filling; dispensing a plurality of customer selected custom formulations with the apparatus, optionally in the absence of a technician for routinely assisting a customer operate the apparatus; and periodically causing the ingredients and packages of the apparatus to be refilled; wherein the apparatus includes a computer, an automated dispensing apparatus for dispensing ingredients from the ingredients containers, a user interface for enabling a customer to select a custom formulation and a housing that contains at least two components of the computer, the automated dispensing apparatus, the ingredients containers and the packages for filling. Optionally, a mixer may be employed to mix the custom cosmetic formulation so as to usable or applable upon receipt thereof.

In another aspect, the method includes the steps of providing at a retail store a point-of-sale custom formulation dispensing apparatus, including a plurality of ingredients containers; dispensing one or more ingredients into at least one container; locating the container at a mixing location using an automated computer control locating mechanism; and mixing the dispensed ingredients.

BRIEF DESCRIPTION OF THE DRAWINGS

FIGS. 9A through B illustrates three axes and a robot arm having six degrees of freedom according to the teachings of the present invention.

FIGS. 10A through B illustrates an exemplary mixing device of the present invention.

DESCRIPTION OF THE INVENTION

Figure 1A:
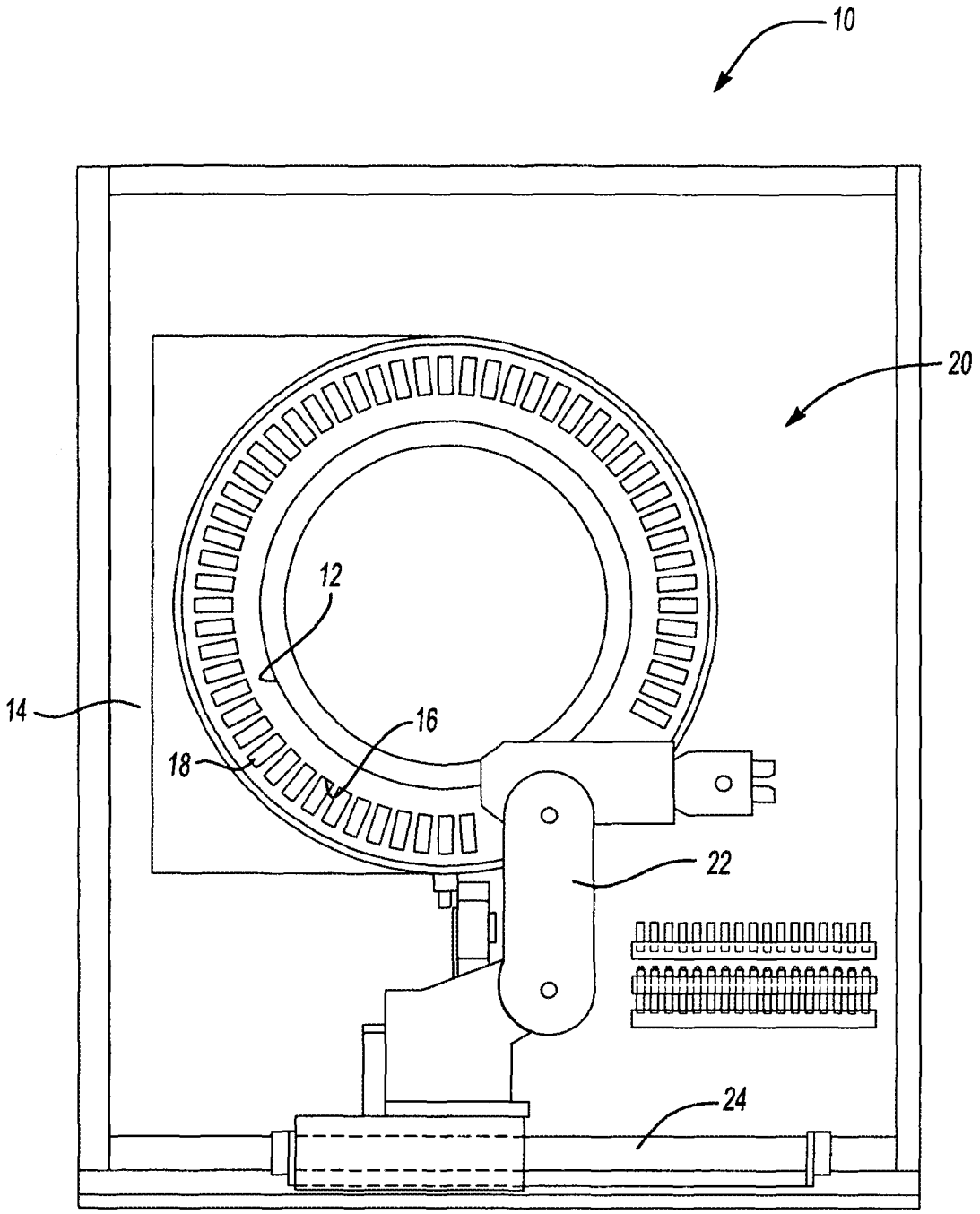
FIGS. 1A through C illustrates one exemplary embodiment of a dispensing apparatus of the present invention.

The present invention provides a method and apparatus for providing a user with the ability for the creation of a customized product, such as a customized cosmetic product, which is user friendly, fun to use and requires substantially no assistance from a technician.

In one aspect, the present invention meets the above needs and contemplates providing an apparatus and method for automated dispensing of customized cosmetics formulations. Advantageously, automation of the present invention allows the dispensing of the customized cosmetic formulations with little to no assistance from a technician. Accordingly, it is possible that the apparatus of the present invention is operated by one or more customers, in the absence of a technician for routinely assisting the customers to operate the apparatus, in a retail point of sale environment for a prolonged period of time (e.g., at least one hour, more particularly at least 3 hours, more particularly at least 8 hours, still more particularly at least two days, and even still more particularly at least 1 week, or even one month). It should be realized that even though one advantage of the present invention is that it does not require the on-site placement of a technician for assisting customers, the methods herein need not be so limited. Accordingly, it is possible that the present apparatus will be operated in the presence of a technician for assisting a customer. Further, though a particular advantage of the present invention is the facilitation and enhancement of a retail point of sale transaction, (such as by user interaction and entertainment by watching the dispensing) the invention is not limited to such an environment. For example, it should be appreciated that placement of an order may be at the site of a retail point-of-sale or at a remote location (e.g., via the Internet or otherwise).

Among the various advantages of the present invention is that it affords a unique customer interactive approach to the sale of items at a retail point of sale. The combination of two or more of enhanced customer involvement in the customization occasioned by a user interface; at least a partially transparent panel for covering the machine but still attracting and allowing the customer to view moving parts associated with the dispensing apparatus and operation; the ability to offer to a customer and produce at the retail point of sale a formulation selection from a choice of more than 50 candidates, more particularly more than 100 candidates, and still more particularly more than 250 formulation candidates without the need to maintain as many candidate choices in inventory, make the present invention particularly beneficial for enhancing product sales, especially in environments such as the retail point of sale cosmetic environment.

In general, the systems of the present invention includes a computer, an automated dispensing apparatus for dispensing ingredients from a plurality of ingredients containers, a user interface for enabling a customer to select a custom formulation and a housing that contains at least two components of the computer, the automated dispensing apparatus, the ingredients containers and the packages for filling.

The apparatus includes a plurality of ingredients containers, each preferably comprising a different color, formulation or otherwise. The ingredients containers may be a plurality of individually separated and individually carried containers, a plurality of containers carried by a common carrier, or a combination thereof. Ingredients containers may include a flexible wall enclosure, a rigid wall enclosure or a combination of the two. One or more of the containers may be at least partially transparent for revealing contents or may be otherwise marked for differentiation among containers within the apparatus. Specific examples of suitable ingredients container may include those described in U.S. Pat. Nos. 6,412,658; 6,622,064, 6,672,341; 6,615,881, all of which are incorporated by reference. To the extent not disclosed in the above patents, examples of such containers may also include bags, cartridges, bottles, vials, tubes, barrels, wells in a block of material, cans, any combination thereof or otherwise. Ingredients containers may themselves incorporate a suitable opening or nozzle through which ingredients will pass to exit the container. A separate nozzle may be attached to the container. Other variations are also possible. Ingredients containers may be disposable or re-useable. It is also possible that the ingredients containers may be formed into a particular shape (e.g., molded for defining a particular trade dress).

As gleaned from the above, the apparatus further typically will include at least one carrier for the ingredient containers. The arrangement of the ingredient containers on the carrier may vary between applications or otherwise. Suitable arrangements include patterns such as radially disposing or linearly disposing of the ingredient containers onto the carrier. However, non-pattern arrangements are also contemplated. The containers may exist on a common plane or on a plurality of planes. Also, the containers may be mounted on an angle with respect to the surface of the carrier. Other configurations are contemplated and within the scope of the present invention.

Figure 1B:
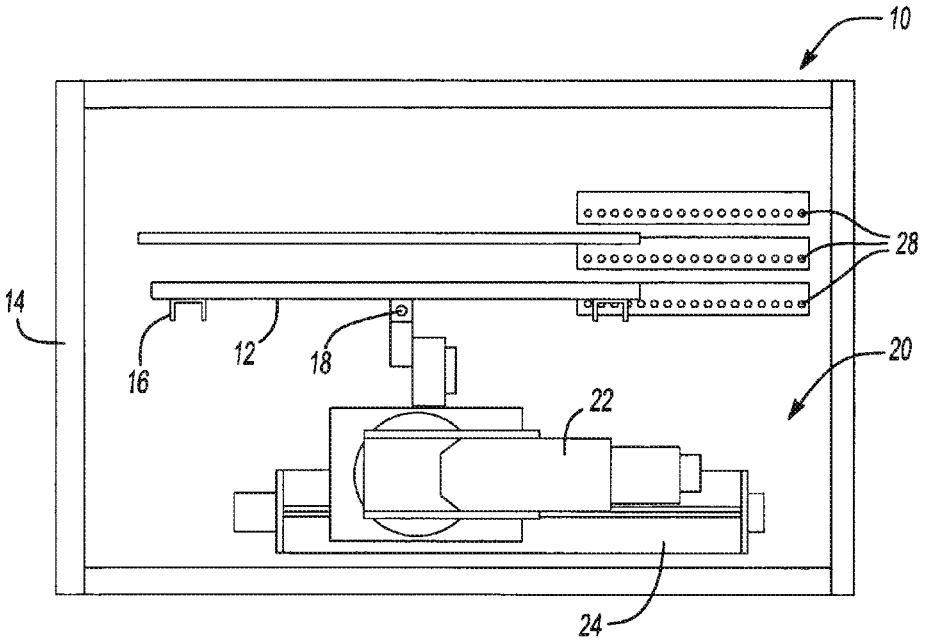
Figure 1C:
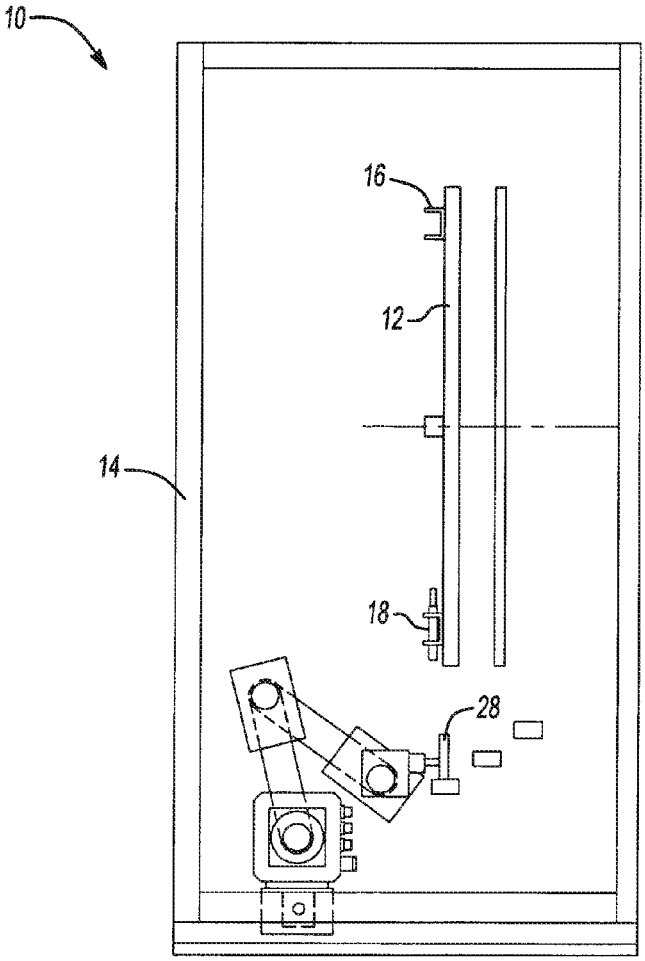

In view of the forgoing, referring to FIGS. 1A-C, one example of a suitable carrier is shown. The carrier comprises a member adapted for radial mounting of a plurality of ingredient container. Though the carrier is depicted as a disk-shaped member, it should be appreciated that other geometrical and non-geometrical configurations are available. The member may include one or two substantially flat mounting surfaces and a plurality of radially located mounting means or is otherwise adapted for radially mounting of the ingredient containers on one or both sides. However, the invention is not confined to radial carrying of containers. The containers may be arranged linearly, according to a particular pattern, linearly at multiple heights (e.g., shelf like), in a plurality of radial configurations, horizontally, at an angle, any combination thereof or otherwise. One of the aspects of the present invention is that it permits for the use of irregular or complex geometries for fixing the location of the ingredients containers within the apparatus. For example, because of the use of one or more programmable robot arms (shown and discussed further herein), the ingredients can be situated randomly within the apparatus and the robot arm will be programmed to locate the proper location and/or cause dispensing from the ingredients containers. It should be appreciated that the robot arm and the carrier are movable relative to one another. Accordingly, the robot arm or the platform may be fixed.

More specifically, advantageously, the dispensing mechanism includes, or comprises of, at least one robot arm, or the like, for providing movement along at least two axes, and optionally along at least three axes or even 6, 8 or more axes. Advantageously, the robot arm may be rotatable about any one of the at least two or at least three axes. As such, in addition to the at least three axes of movement of the robot arm (as demonstrated in FIG. 9*a*), the robot arm is adapted for rotational movement about one or more of the at least three axes thereby generating at least six degrees of freedom. An example of a suitable robot arm is shown in FIG. 9*b*, wherein the robot arm includes six degrees of freedom based upon movement about six axes. It should be appreciated that the degrees of freedom of the robot arm of the present invention may include 2, 3, 4, 5, 6, 7, 8, 9, 10 or more degrees of freedom.

Alternatively, or in combination therewith, the dispensing mechanism, supporting a robot arm may also be adapted for movement along at least two axes, and optionally along three axes. Furthermore, as with the robot arm, the dispensing mechanism may also be rotatable about any of the at least three axes for generation of six degrees of freedom. For example, the entire dispensing mechanism, including a robot arm, may move in a similar manner to that of a plotting device, wherein two substantially perpendicular tracks are providing for moving the dispensing mechanism with respect to the carrier and ingredient containers. Once the dispensing mechanism has moved to the desired location, the robot arm can additionally move, as discussed herein, to facilitate in the dispensing of ingredients, or otherwise, wherein movement includes movement along at least two axis including rotation about any of its axes, linearly moveable in at least two of x, y and z axis, rotatable about at least two of x, y and z axis, or both.

Movement of the dispensing mechanism may be achieved using any suitable drive mechanism. A preferred drive mechanism includes pneumatic, hydraulic, electrical or mechanical drive means. For example, a suitable mechanical means includes a stepper motor for movement in at least one axis. It should be appreciated with linear movement along two axes using a stepper motor, movement of the dispensing mechanism may comprise substantial linear or slight arcuate movement as oppose to movement along one axis followed by subsequent movement along a second axis. As previously mention, this movement is similar to that commonly seen in plotter configurations.

In view of the forgoing, it should be appreciated that the dispensing mechanism may provide movement in at least two axes and the robot arm may also provide movement in at least two axes include rotational movement. This capability provides flexibility with the mounting of containers among other advantages. Furthermore, in view of at least a partially transparent housing, as discussed herein in more detail, a spectacular dispensing performance is provided to the end user. Though at times one arm is depicted, it is contemplated that a plurality of robot arms may be arranged, either with the dispensing mechanism and/or including movement of packages or independently, for dispensing of the ingredient from the containers. It should be appreciated that other numerous configurations are available for accessing different regions of a 2 or 3 dimensional grid, using a robot arm.

Additionally, the arm is configured for movement, as described above, or optionally as described below or otherwise, for dispensing of the ingredient from within an ingredient container. It should also be appreciated that the robot arm may provide more functions than was has been described thus far. For example, the robot arm may be further configured for retrieval, placement and removal of a package from a dispensing site of the dispensing apparatus. Also, the robot arm may be further configured for replacement of the ingredient containers on the carrier upon substantial expiration of the contents located therein. In view of the above two additional examples, the robot arm may be configured with corresponding grasping means for removal, attachment and manipulation of an ingredient container, package or otherwise.

As mentioned above, the robot arm may be configured for the dispensing of the ingredients, wherein the robot arm and the carrier and/or packages are movable relative to each other. By example, in one aspect, the robot arm is configured to withdrawal (via vacuum, suction or otherwise) one or more ingredients from an ingredient container and expel the ingredients into a package. Accordingly, the robot arm may also carry one or more needles, ladles, aspirating tubes or other suitable devices that can be dipped into the ingredients container and withdraw ingredients. As such, it should also be appreciated that the dispensing device may further include a purging or cleaning device for cleaning needles, ladle or other suitable tubes used for aspirating, which is particularly advantageous when one device is used to withdrawal contents from more than one ingredient container. In another aspect, the robot arm is configured to actuate expulsion of the ingredient through an orifice of the ingredient container. Accordingly, the robot arm may apply a force to cause the container to expel an ingredient. In yet another aspect, the robot arm is configured to retrieve one or more ingredient containers and move it to a dispensing location for dispending into a package and subsequently replace the container back to its original position. Other configuration are contemplated and within the scope of the present invention.

The ingredient containers mounted to the carrier are preferably replaceable upon substantial expiration of the contents inside or otherwise. As such, preferably, the mounting means for the containers allow for subsequent removal of the containers for replacement. Replacement of the containers may be performed by a technician or automated, as described herein. As such, it is further contemplated that the container, carriers, dispensing mechanism, or otherwise includes a sensor for monitoring the amount of ingredients remaining in one or more, and preferably all, of the ingredient containers. Suitable sensors include position sensors, weight sensors, pressure sensors, any combination thereof, or otherwise.

The dispensing mechanism for dispensing of the ingredients through the nozzles, or otherwise, may use any suitable dispensing means for pressurizing the contents located within the ingredient containers. Such pressurization would result in the dispensing of the ingredients proportional to the amount of pressurization within the ingredient containers. Suitable dispensing mechanism include pneumatic or hydraulic pressurization means, mechanical pressurization means (e.g., a drive piston mechanically linked to a dispensing mechanism), vacuum or suction draw (e.g., aspiration, the like or otherwise), or otherwise. It should be appreciated that numerous means are available for dispensing the cosmetic ingredients from a container. Furthermore, it should be appreciated that dispensing of the ingredients may also be based upon the duration of pressurization. Alternatively, the dispensing of the ingredients may be based upon a specified displacement of the ingredients from within the container.

One preferred dispensing mechanism includes mechanical drive means for urging the ingredient from within the container through an associated nozzle. By example, mechanical drive means may include a drive piston, or the like, located within the ingredient container and optionally in contact with the ingredients located in the cosmetic container. Alternatively, the drive piston may be attached as a movable member associated with the ingredient container, wherein movement of the moveable member results in dispensing of the ingredients from within the container. Regardless to the configuration, the drive piston is moved, preferably axially, to pressurize the ingredient container or otherwise displace the ingredients. Such movement may be derived from reciprocating or rotational movement of a member of the dispensing mechanism, though other configurations are available.

In another configuration, pneumatic or hydraulic pressure may be used to pressurize the container and urge the ingredient from within the container through an associated nozzle or otherwise. In a first example, a pressure line may be attached directly to the ingredient container. In a second example, pressure may be used to drive a piston or the like located within the ingredient container in a similar fashion to that discussed in the above mechanical drive means. In either example, a proportionate amount of ingredients are urged from an ingredients container and out of an associated nozzle and preferably into a package.

The apparatus further includes a drive mechanism for movement of the carrier and/or dispensing mechanism. The drive mechanism is adapted for alignment of the components of the apparatus such that one or more of the ingredients located in the ingredient containers may be dispensed into a package. In one aspect, the alignment of the components may comprise alignment of the dispensing mechanism with an ingredient container located on the carrier. In another aspect, the alignment may comprise alignment of the nozzles associated with one or more ingredient containers with a package. In yet another aspect, the alignment may comprise both the alignment of the dispensing mechanism with the ingredient containers and alignment of the ingredient containers and/or associated nozzles with a package. It should be appreciated that other configurations are possible and within the scope of the present invention.

Suitable drive mechanisms includes mechanical (e.g., belt driven or otherwise), electrical (e.g., solenoid driven or otherwise), fluid drive (e.g., hydraulically driven or otherwise), combinations thereof or otherwise. For example, a belt may be attached to a disk carrier for moving the ingredient containers with respect to a dispensing mechanism, wherein a suitable motor (e.g., electric, hydraulic or mechanical or otherwise) provides movement of the belt and hence the disk carrier. In another example, a belt may be attached to an elongated carrier adapted for axial movement, wherein a suitable motor (such as a stepper motor or otherwise) provides axial movement of the elongated carrier.

The ingredient containers and the robotic arm of the dispensing apparatus may be movably mounted with respect to one another. It should also be appreciated that plural robot arms may be employed, such as one for retrieving an ingredients container and another for causing ingredients to be removed from the container.

The first and second suitable carriers may be mounted, attached or otherwise disposed on, or within, a suitable housing. Likewise, the dispensing mechanism, control device or other associated components are located substantially on, or within, the housing. Optionally, it should be appreciated that the user interface may be located in or on the housing to form a monolithic structure (i.e. a self-contained structure) such as a kiosk, adapted for the customized selection and dispensing of a product.

The housing may be suitably sized for any given application. For example, the housing may be sized to be mounted on a counter top or the like. Alternatively, the housing may comprise a stand alone self-contained monolithic structure. It should be appreciated that smaller or larger configurations of each are available. However, preferably the housing is sized so as to receive two or more components such as the ingredient containers and the robotic arm, though other configurations are available. In one exemplary embodiment, shown in FIG. 1, the housing may comprise a height of about 60 inches, width of about 53 inches and a depth of about 34 inches. Advantageously, in one configuration the dispenser apparatus is suitably sized to be placed at a retail point-of-sale, e.g., having an overall volume less than 60 cubic feet, more preferably less than 30 cubic feet or still more preferably even less than 10 cubic feet or even less than about 5 cubic feet. However, the dispensing apparatus may be suitably sized for placement at a non-retail point-of-sale (e.g., factory, warehouse, or otherwise). It should be appreciated that other proportionate and non-proportionate sizes are available.

The ingredients of the ingredient containers are preferably adapted to be mixed together to form a customized product. The customized product may be liquid or powder in form. Advantageously, in one example, the customized product includes a cosmetic product. Such cosmetic products may include, but is not limited thereto: lipstick, eye shadow, lip gloss, foundation, lip liner, nail polish, blush, eye shadow, mascara, body lotion, face powder or otherwise. As such, it should be appreciated that the packages receiving the mixture of ingredients comprises packaged typically used for storing such cosmetics (e.g., nail polish container, lip gloss container or otherwise). Likewise, it should be appreciated that the container may include one or more applicators for applying the same. Other ingredients that may be stored and dispensed from the ingredient containers include gloss, glitter, tints, sparkles or other effects that may be advantageous with a cosmetic, or other, customized product.

In another aspect, ingredients may be made available for improving, maintaining or otherwise positively effecting the quality or appearance of the surface it is applied to (e.g., skin or otherwise). For example, the present invention further contemplates the dispensing of beneficial ingredients such as dietary supplements, nutritional ingredients, medicinal ingredients or otherwise into a package, either alone or in combination with other ingredients, as disclosed herein, for application by a user. For example these beneficial ingredients may include vitamins, herbs, oils, minerals, fiber, insulin (e.g., for diabetic individuals), plant extracts (e.g., aloe or otherwise), or otherwise. Accordingly, cosmetic product such as foundation, blush, body or face lotion, body or face powder may have dispensed therewith vitamins, plant extract, or otherwise into a package for providing a user with a customized product that also function in preserving the appearance of skin. Alternatively, these ingredients may be formed into a unitary structure, such as a bar, tablet or otherwise, where a package may not be necessary for presentation to a user. It should also be appreciated that the dispenser may dispense nutrients, vitamins, dietary supplements alone as a preformed tablet, pill, gelatin or otherwise.

In another aspect, the ingredients may comprise one or more detergents, cleansers, or the like, for cleansing. These cleansing ingredients may be dispensed alone or with other ingredients such as effects, beads, fragrances, or otherwise. Advantageously, these cleansers may be dispensed as a unitary structure such as a soap bar, tablet or the like. Alternatively, such customized cleanser product may also be dispensed into a package, which is particularly useful when the resulting combination is a liquid. Still further, the ingredients contained herein, e.g., cleansers or otherwise, may be dispensed onto a patch, fibrous ball (e.g., cotton ball), towellete, wipe, sponge, textile, another re-usable or single-use disposable porous member, or otherwise as described herein.

In yet another aspect, it is further contemplated that the ingredients described herein may be provided, or combined, for internal consumption by a user. Such internal application may improve overall health of the consumer or to improve the health of specific regions of the consumer, such as skin, hair, vitality, agility or otherwise. For example, ingredients such as dietary supplements, nutritional ingredients, medicinal ingredients or otherwise as contained herein may be combined to form a consumable product, which preferably is based upon the recommended daily dosage, if one exists. Accordingly, it should be appreciated that the ingredients are dispensed into capsule (such as a gelatin capsule), compressed into a tablet (which may be chewable), or in other containers that is dissolvable in the presence of digestive enzymes or other bodily fluids. Still further, it is contemplated that these internally consumable ingredients may be dispensed into a package for subsequent consumption by a user. For example, eye drops, ear drops or other internally applied agents may also dispensed into a package. Other customized consumable products should be appreciated with the present invention.

For each of these examples it is contemplated that a user will benefit from the use of information retrieval devices, such as a Radio Frequency Identification Device (RFID), or other data storage devices as described herein. In this manner, users can track information relating to the health, other attributes of the user, or otherwise. For example, the RFID may be configured to store information relating to the amount of products purchase, consumed or otherwise dispensed from the dispensing apparatus of the present invention. The RFID may further be configured to store, record and/or monitor diet, weight, cholesterol, blood sugar or other levels or parameters related to the health of the user or otherwise. The RFID may still further be configured to make recommendations of ingredients to be dispensed from the dispensing apparatus based upon stored information in the RFID, which optionally is related to the user.

In view of the forgoing, referring to FIGS. 1A-B, a first exemplary embodiment of the dispensing apparatus 10 of the present invention is shown. The apparatus includes a carrier 12, which is rotatably mounted to a housing 14 and driven by a motor, via a belt or the like. Preferably, the housing is adapted to enclose a substantial portion of the components of the apparatus and may optionally include one or more transparent panels for view of the components during dispensing or otherwise. The carrier further includes a plurality of mounts 16 which are radially displaced about the carrier and provide removable attachment for ingredient containers 18, wherein the ingredient container includes a nozzle 19 extending radially away from the central portion of the carrier.

The apparatus further includes a dispensing mechanism 20 including one or more robot arms 22 mounted to the housing and optionally movable along a guide 24 (such as a shaft member or otherwise). The robot arm is configured for positioning over, or proximate to, an ingredient container and for subsequent movement, or otherwise functioning, to cause the ingredients from within the container to be transferred into a package 28. The robot arm or another robot arm may be configured for engagement and movement of a package to and/or away from a dispensing site. Control of the drive motor (e.g., the rotation of the carrier) and the dispensing mechanism is achieved via a controller, which may or may not be located within or otherwise attached to the housing. A preferred controller comprises a computer or the like.

Figure 2:
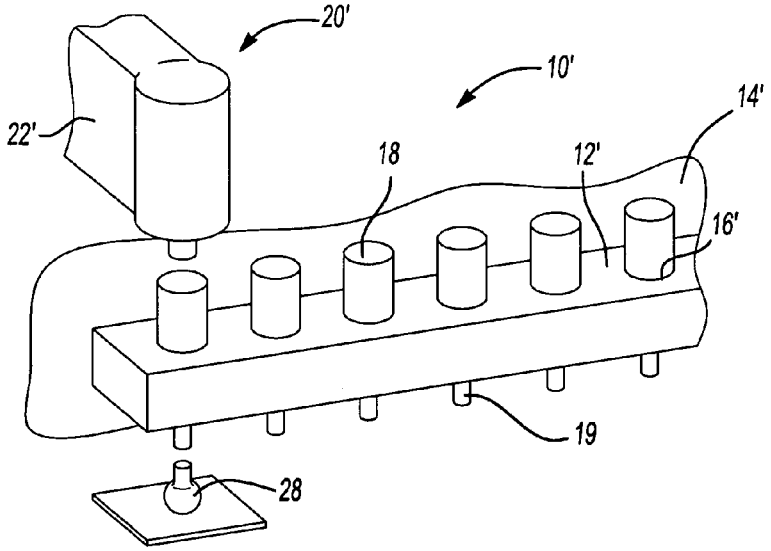
FIG. 2 illustrates another exemplary embodiment of a dispensing apparatus of the present invention.
Figure 3A:
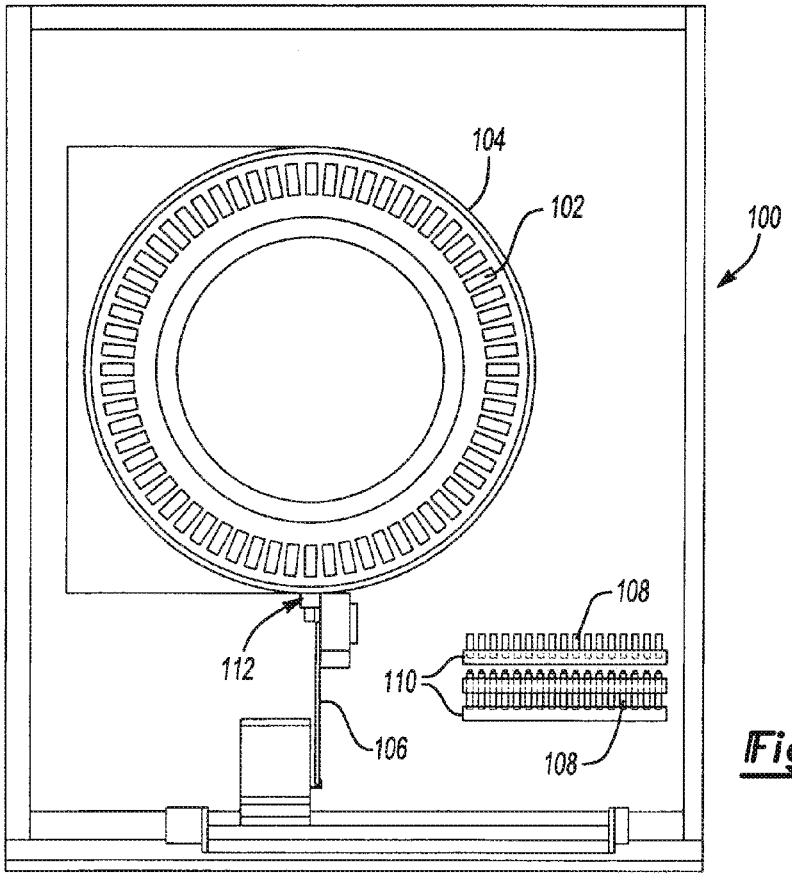
FIGS. 3A through 8B illustrate yet other exemplary embodiments and/or features of a dispensing apparatuses of the present invention.
Figure 3B:
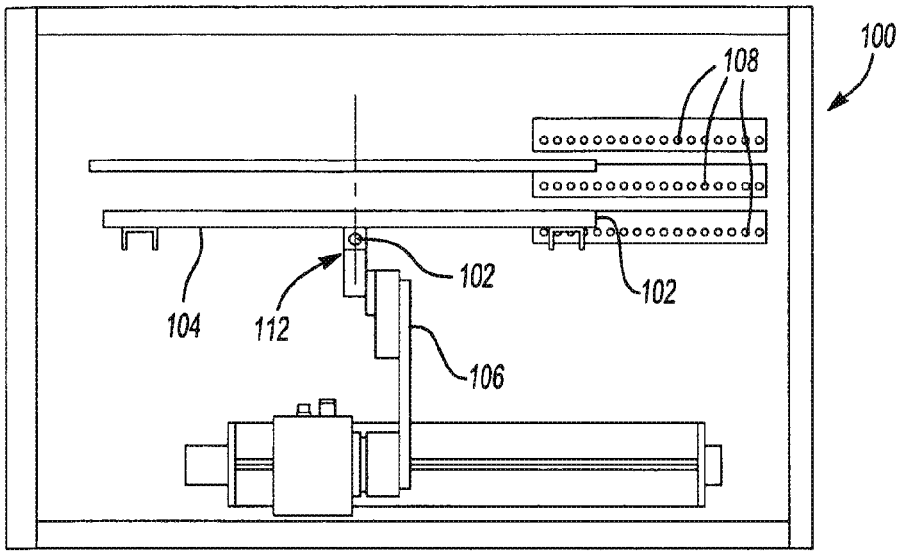
Figure 3C:
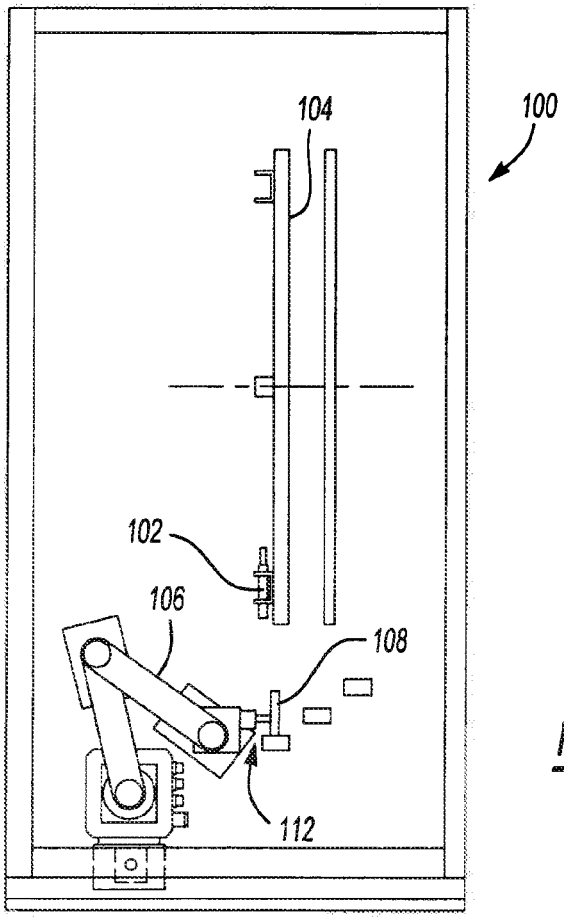
Figure 3D:
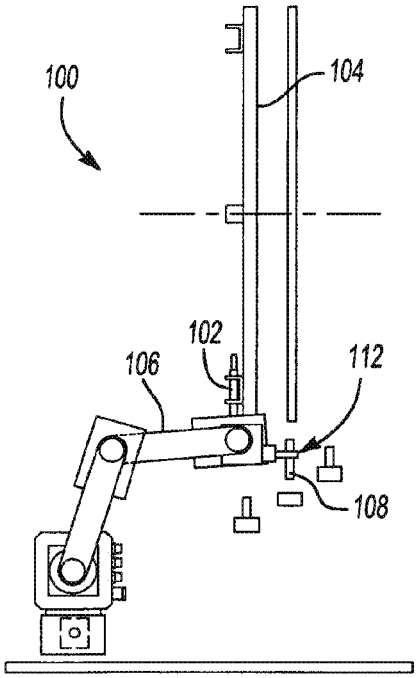
Figure 3E:
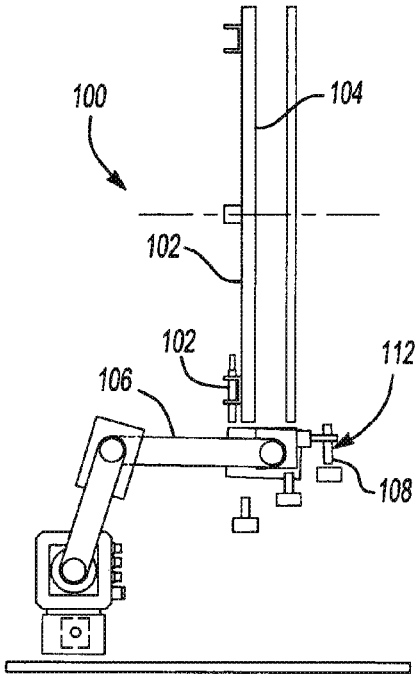
Figure 3F:
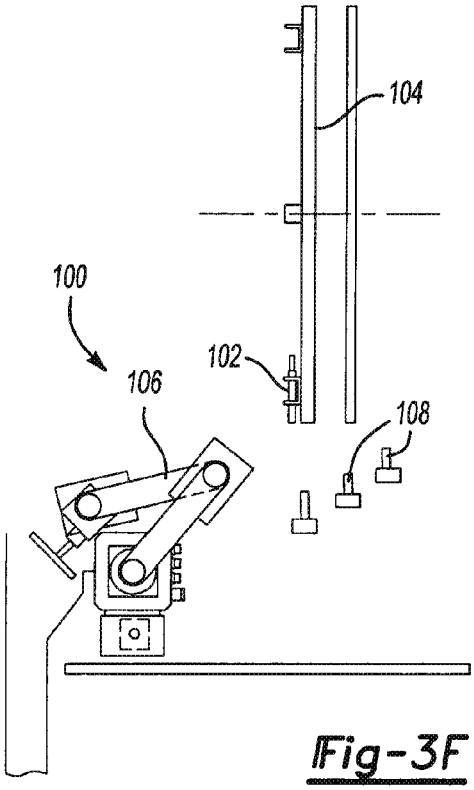

Referring to FIG. 2, another exemplary embodiment of the dispensing apparatus 10' of the present invention is shown. The apparatus includes a carrier 12', which may be movably mounted, via a motor, or alternatively fixedly attached to a housing 14'. Preferably, the housing is adapted to enclose a substantial portion of the components of the apparatus. The carrier further includes a plurality of mounts 16' which are axially displaced along the carrier and provide removable attachment for ingredient containers 18, wherein the ingredient container includes a nozzle 19, which preferably extends downward with respect to the housing.

The apparatus further includes a dispensing mechanism 20' including a robot arm 22' mounted to the housing and optionally movable along a guide (such as shaft like member or otherwise). The robot arm is configured for positioning over, or proximate to, an ingredient container and for subsequent movement, or other functioning, to cause the ingredients from within the container to be expelled into a package 28, which may be movable with the robot arm or another robot arm or otherwise. Control of the drive motor (i.e., the movement of the carrier) and the dispensing mechanism is achieved via a computer (e.g., a controller module), which may or may not be located within or otherwise attached to the housing.

In another configuration a robotic arm is movably located adjacent to a first carrier having a plurality of radially disposed ingredient containers, and a second carrier having a plurality of linearly disposed packages and optionally associated components (e.g., package caps, applicators or otherwise). The robotic arm is driven via electric, hydraulic or by other means. The dispensing apparatus further includes a dispensing site, such as a nest or otherwise, for placement of the package during dispensing. Advantageously, the robotic arm includes one or more rotatable members for rotation about one or more axes, wherein preferably, one of the at least two moveable members includes a gripping mechanism for grasping a package, or otherwise, located on the second carrier and for placement at a point of dispensing, which preferably is located below one or more ingredient containers located on the carrier. The dispensing apparatus further includes a dispensing mechanism such as previously discussed, which may or may not be associated with the robot arm or otherwise comprise a robot arm, for the dispensing of the ingredients located in the ingredient containers. While the ingredients may include any of the ingredient discussed herein, in one preferred embodiment, the ingredients comprises a liquid component (e.g., a lip-gloss, foundation additive therefore or otherwise). Either or both of the gripping mechanism or the dispensing mechanism can be mounted on a suitable automated device such as a computer controlled robot arm. Furthermore, it should be appreciated that the selected components to be dispensed into the package are based upon a formula of a selected customized cosmetic product as discussed herein or otherwise. With regards to dispensing of a foundation into a package, the robot arm picks up a package and places it at the dispensing site, e.g., nest or otherwise. A cylinder opens a valve of an ingredient container, such that ingredients are dispense from the ingredient container into the package. The cylinder and valve are then closed after a selected amount of ingredients dispensed and the steps are repeated with other ingredients to form a customized foundation product. Optionally, the robot arm picks up and installs a cap on the package and subsequently presents it to the user.

An example of the previous embodiment may be seen in FIGS. 3A-F. In this example, an automated customized dispensing apparatus 100 is shown including a plurality of ingredient containers 102 radially disposed about a first carrier 104, wherein the ingredient containers comprise a container with an opening, such as a syringe-like device having a nozzle. The dispensing apparatus further includes a robot arm 106, which may or may not be associated with a dispensing mechanism as previously discussed, adapted to pick up a main body such as a package 108 or otherwise from a second carrier 110 and place it at a dispensing site, such as a rotary nest, which may be located in the gripping portion 112 of the robot arm, on the dispensing apparatus or elsewhere. The carrier wheel turns to locate a color in an ingredient container, optionally as the nest raises. A cylinder or other member of the dispensing mechanism then extends and depresses a syringe located with the ingredient container, to dispense the ingredients located therein. Optionally, the nest may rotate or otherwise move into a suitable position for receiving the ingredients expelled from the ingredient container. It should be appreciated that this step may be repeated for additional ingredients, such as color, shimmer, flavoring, combinations thereof or some other effect, to create a customized cosmetic product. Preferably, upon completion of combining of the ingredients, the nest retracts.

Advantageously, the dispenser may mix the combined gradients located in the package. For example, the robot arm may further select a mixing member, such as a biasing member (e.g., a spring), and agitate the contents within the package by placing and moving (e.g., raising, lowering, spinning or otherwise) the biasing member within the package. Upon completion of the mixing, the mixing member is returned to its original position. However, it should be appreciate that the mixing member may be substantially stationary and the package is moved to agitate the contents therein. Other mixing means are available and should be appreciated and as further discussed herein, particularly with references to FIGS. 10A through 13B. Optionally, the robot arm picks up a cap, and/or other component, and installs the cap (via snap fit, screw or otherwise) onto the package. The robot arm then picks up the package and presents the final customized product to the user.

Figure 4A:
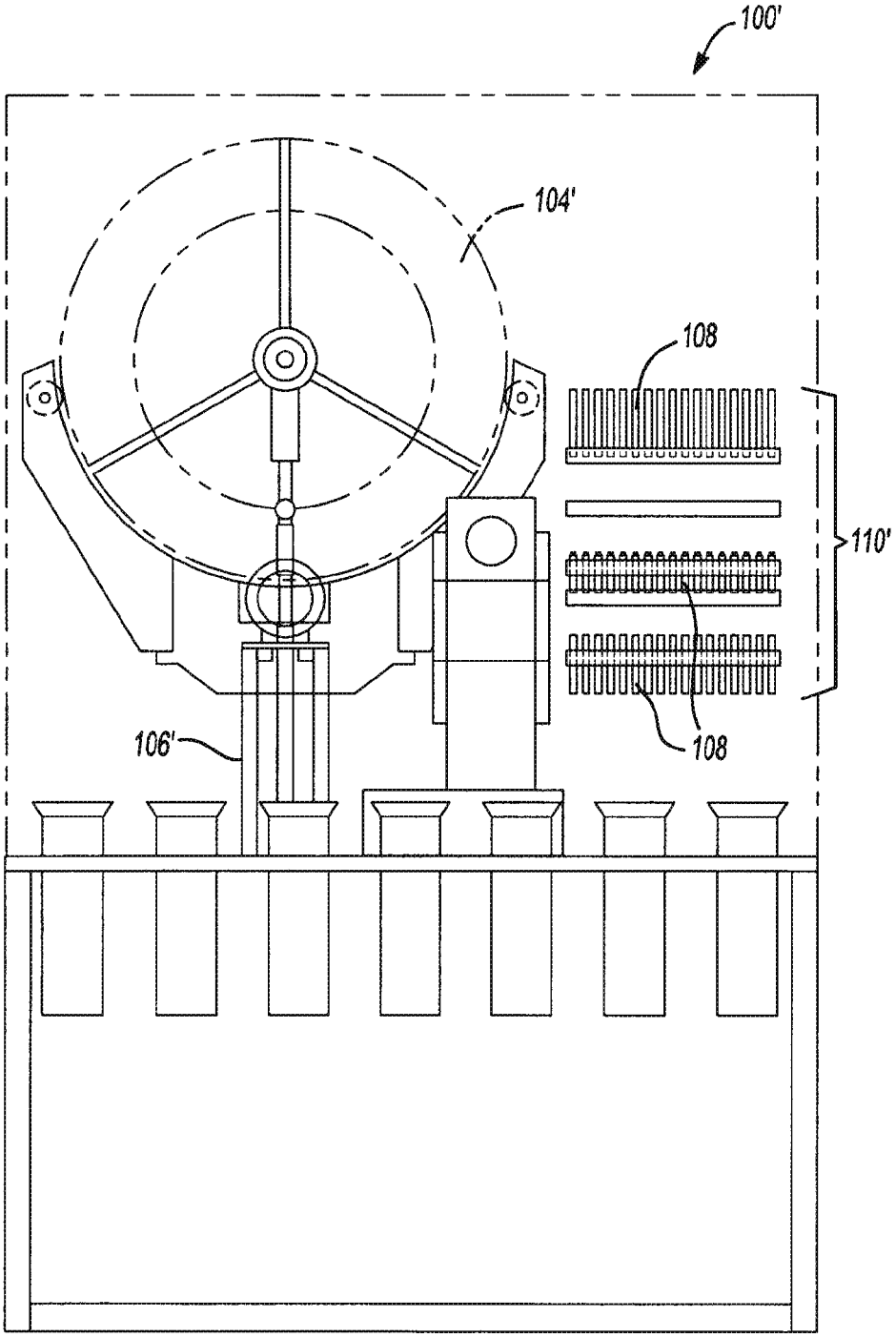
Figure 4B:
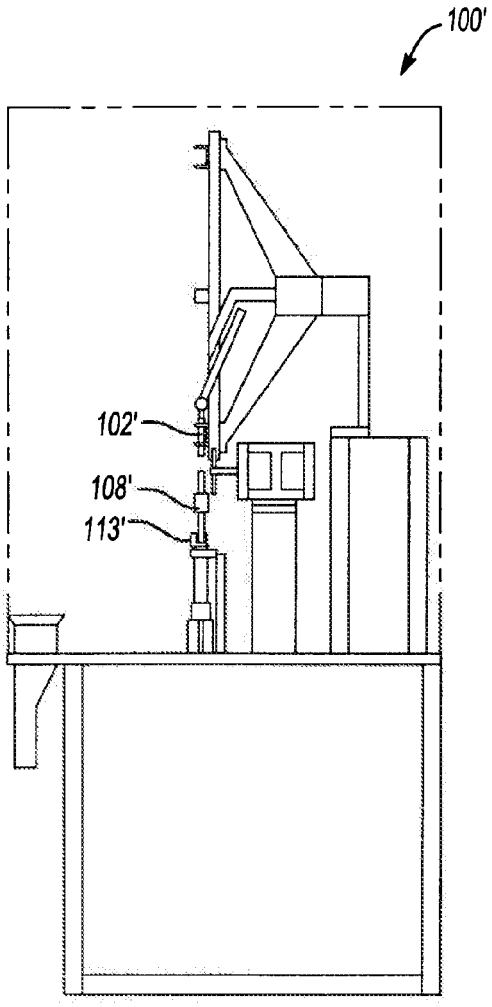
Figure 4C:
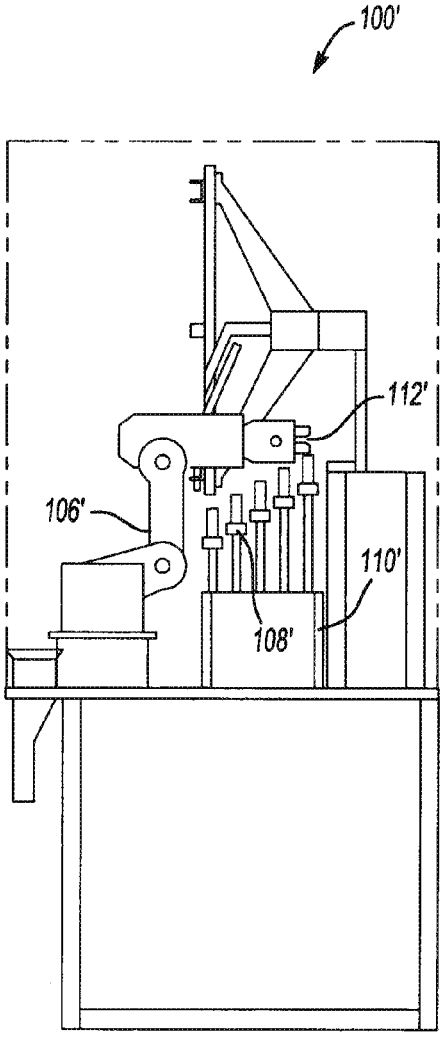
Figure 5A:
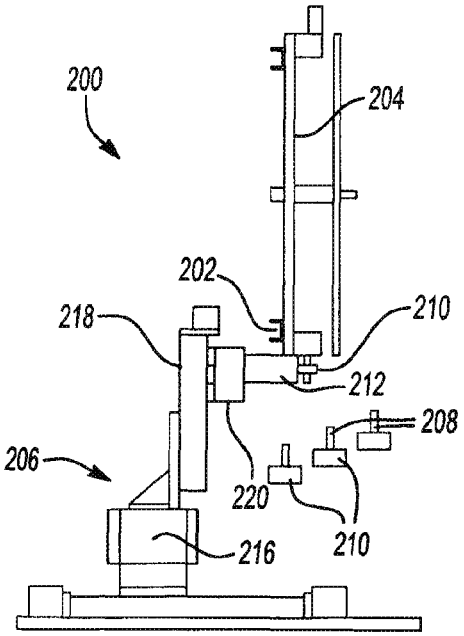
Figure 5B:
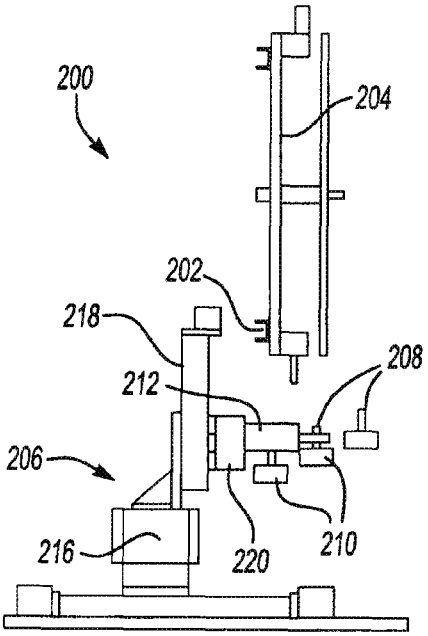
Figure 5C:
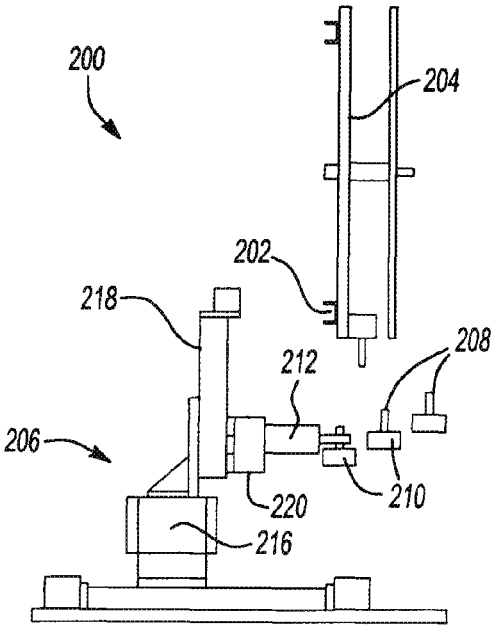
Figure 5D:
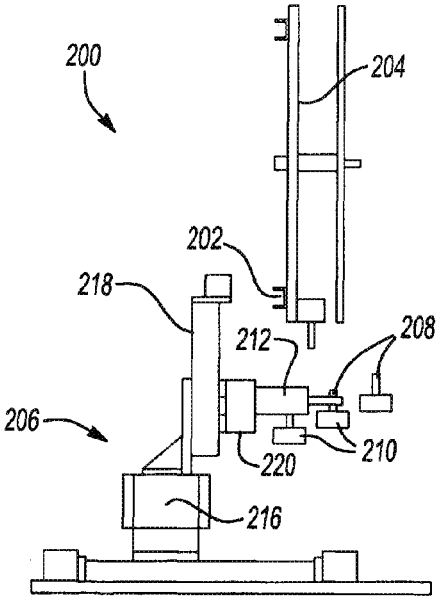
Figure 5E:
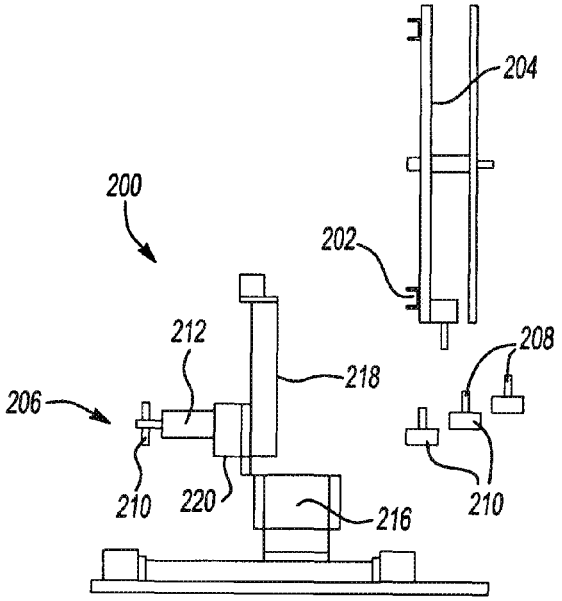

Another feature of the present invention may be seen in FIGS. 4A-C. In the embodiment shown, an automated customized dispensing apparatus 100' is illustrated including a plurality of ingredient containers 102' radially disposed about a first carrier 104', wherein the ingredient containers comprise a container with an opening, such as a syringe-like device having a nozzle. The dispenser apparatus further includes a six axis robot arm 106' adapted to pick up a main body such as a package 108' or otherwise, via a grip device 112', from a second carrier 110' and place it at a dispensing site such as a rotary nest 113' on the dispensing apparatus or elsewhere. Though shown as radially disposed, the ingredients containers may be linearly disposed or disposed as otherwise disclosed herein. The carrier wheel turns or otherwise moves to locate a color in an ingredient container as the nest raises. A cylinder or other member of the dispensing mechanism 115' then extends and depresses a syringe located with the ingredient container, to dispense the ingredients located therein. Optionally, the nest may rotate vertically move or otherwise be located into a suitable position relative to the ingredient container for receiving the ingredients expelled from the ingredient container. It should be appreciated that this step may be repeated for additional ingredients, such as color, shimmer, flavoring, or otherwise, to create a customized product. Upon completion of combining of the ingredients in the package, either or both of the ingredients container or the nest retracts relative to the other. Advantageously, the dispenser may mix the combined gradients located in the package. For example, the robot arm may further select a mixing member, such as a mixing member (e.g., a spring), and agitate the contents within the package by placing and moving (e.g., raising, lowering, spinning or otherwise) the mixing member within the package. Upon completion of the mixing, the mixing member is returned to its original position. However, it should be appreciate that the mixing member may be substantially stationary and the package is moved to agitate the contents therein. Other mixing means are available as described herein and should be appreciated. Optionally, the robot arm picks up a cap, and/or other component, and installs the cap (via snap fit, screw or otherwise) on the package. The robot arm then picks up the package and presents the final customized product to the user. It should be appreciated that the functions of this embodiment may be automated based upon a user's selection of a customized cosmetic product.

In yet another aspect, the present invention provides an automated customized dispensing apparatus including a Cartesian table adapted for movement along three axes (e.g., X, Y and Z axes), which is preferably adjacent to a first carrier having a plurality of radially disposed ingredient containers, and a second carrier having a plurality of linearly disposed packages and optionally associated components (e.g., package caps, applicators or otherwise). The Cartesian table may be designed as a parametric model allowing a maximum amount of ingredient containers to be utilized (e.g., maximizing the width, height and depth configuration of ingredient packages), thereby improving customer selection, and adaptability to trends in the customized cosmetic industry. Furthermore, this allows for additional carriers of ingredient containers to be added, removed or replaced to provide greater or different customized cosmetic formulations. The dispensing apparatus further includes a dispensing site, such as a nest or otherwise, for placement of the package during dispensing. Advantageously, the table, the ingredients containers, or both are mounted to one or more slide members for movement relative to each other. The table may include for example a rotatable member adapted for rotational movement and mounted to a base portion. The table may further include a vertical member, attached to the rotatable member, having tracks for receiving a slide member, wherein the slide member moves vertically along the slide member. Preferably, the slide member includes a gripping mechanism for grasping a package, or otherwise, located on the second carrier and for placement at a point of dispensing, which preferably is located below one or more ingredient containers located on the carrier. The dispensing apparatus further includes a dispensing mechanism, which may or may not be associated with the Cartesian table, for the dispensing of the ingredients located in the ingredient containers. While the ingredients may include any of the ingredient discussed herein, in preferred embodiment, the ingredients comprises a liquid component (e.g., a lip-gloss, foundation additive therefore or otherwise). Furthermore, it should be appreciated that the selected components to be dispensed into the package are based upon a formula of a selected customized cosmetic product as discussed herein or otherwise. With regards to dispensing of a foundation into a package, the Cartesian table picks up a package and places it at the dispensing site, e.g., nest or otherwise. A cylinder opens a valve of an ingredient container, or otherwise, such that ingredients dispense from the ingredient container into the package. The cylinder and valve are then closed after a selected amount of ingredients dispensed and the steps are repeated with other ingredients to form a customized foundation product. Optionally, the Cartesian table picks up and installs a cap on the package and subsequently presents it to the user.

An example of the above embodiment may be seen in FIGS. 5A-E. In this embodiment, an automated customized dispensing apparatus 200 is shown including a plurality of ingredient containers 202 disposed on a first carrier 204 (e.g., shown as radially, but could be otherwise), wherein the ingredient containers comprise a container with an opening, such as a syringe-like device having a nozzle. The dispenser apparatus further includes a Cartesian table 206, adapted for movement along three axes (e.g., X, Y and Z axes), which may or may not be associated with a dispensing mechanism, and adapted to pick up a main body such as a package 208 or otherwise from a second carrier 210 and place it at a dispensing site such as a nest (e.g., a rotatable nest), which may be located in the gripping portion 212 of the Cartesian table, on the dispensing apparatus or elsewhere. Preferably, the table includes a rotatable member 214 adapted for rotational movement and mounted to a base portion 216. The table further includes a vertical member 218, attached to the rotatable member, having tracks for receiving a slide member 220, wherein the slide member moves vertically along the slide member and preferably includes the gripping portion 212. The carrier is actuated to locate a color in an ingredient container, such as when as the nest is raised. A cylinder of the dispensing mechanism then extends and depresses a syringe located with the ingredient container, to dispense the ingredients located therein. Optionally, the nest may rotate or otherwise move into a suitable position for receiving the ingredients expelled from the ingredient container. It should be appreciated that this step may be repeated for additional ingredients, such as color, shimmer, flavoring, or other effect, to create a customized product. Upon completion of combining of the ingredients in the package, the nest retracts. Advantageously, the dispenser may mix the combined gradients located in the package. For example, the Cartesian table may further select a mixing member, such as a spring, and agitate the contents within the package by placing and moving (e.g., raising, lowering, spinning or otherwise) the spring within the package. Upon completion of the mixing, the mixing member is returned to its original position. However, it should be appreciate that the mixing member may be substantially stationary and the package is moved to agitate the contents therein. Other mixing means are available and should be appreciated. Optionally, the Cartesian table picks up a cap, and/or other component, and installs the cap (via snap fit, screw or otherwise) on the package. The Cartesian table then picks up the package and presents the final customized product to the user. It should be appreciated that the functions of this embodiment may be automated based upon a user's selection of a customized cosmetic product.

In yet another aspect, the present invention provides a dispensing apparatus having an automated electric valve for the dispensing liquid material. It should be appreciated that the electric valve dispensing device may be in replacement of, or in addition to, any of the previously mentioned dispensing components disclosed herein, and still other configurations are available as further demonstrated herein. Also, it should be appreciated, a plurality of electric valve configuration may exist in a single dispensing unit.

Figure 6:
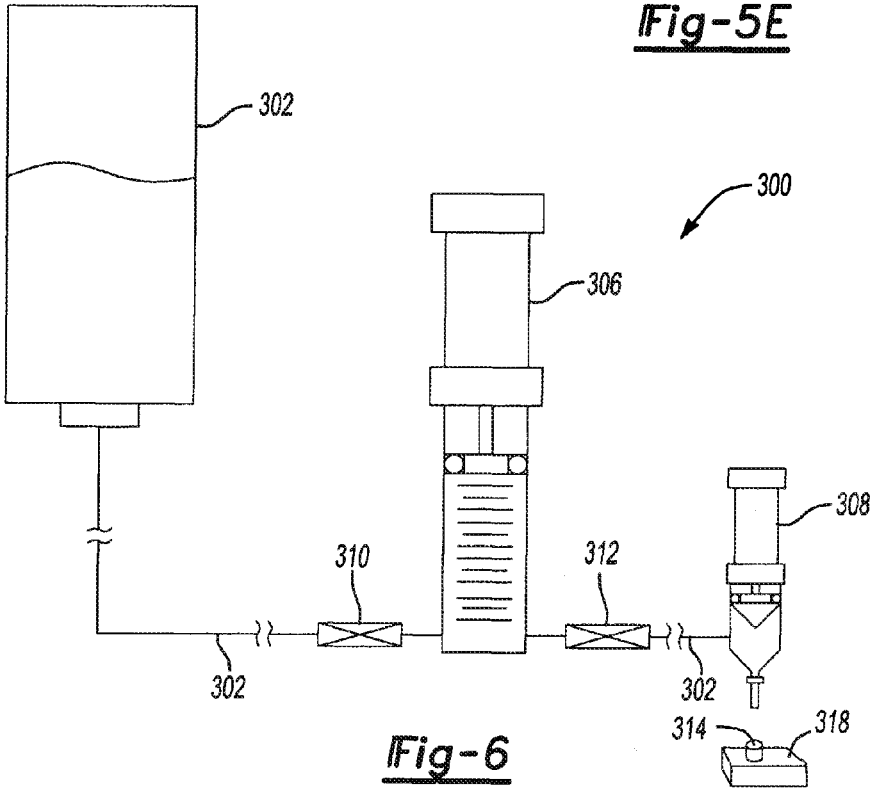

As demonstrated in FIG. 6, one example of a valve 300 is illustrated. The valve includes an ingredient container (e.g., a fluid reservoir) 302 in fluid communications, via a conduit 304, with a dispensing mechanism (e.g., a servo mechanism, which may comprise a graduated cylinder for measurement, a stepper motor or otherwise) 306. The dispensing mechanism is in fluid communication with an electronic valve 308. Advantageously, a first and/or second check valve 310, 312 may be placed along the fluid conduits between the ingredient container and the drive mechanism, and/or between the drive mechanism and the electronic valve. Though, the dispensing mechanism is configured for liquid dispensing, other materials may be dispensed. In operation, the first check valve 310 opens and the servo retracts within the cylinder thereby drawing into the graduated cylinder a proportionate amount of ingredients from the ingredient container. The first check valve then closes and the second check valve and valve opens. The servo extends to its original position and expels the ingredients therein along the conduit and a proportionate amount of fluid is expelled through the valve and into a package 314, which is optionally placed in a second carrier 318 or is otherwise nested. Thereafter, the valve and the check valve close thereby rendering the system ready for another cycle. It should be appreciated that the functions of this embodiment may be automated based upon a user's selection of a customized cosmetic product.

Still, in another aspect, the present invention further provides a dispensing apparatus includes a track system for transporting a package to one or more dispensing sites. In such a apparatus, the track system includes a track adapted for guiding a member (such as a nesting block) along the same to one or more dispensing sites, which are preferably located below a nozzle associated with one or more ingredient containers. In a preferred embodiment, the movable member is adapted for receiving and holding a package, as described herein. The drive system for driving the moveable member includes any suitable system; however, an exceptionally suitable drive system may include an electric motor adapted to drive a belt or chain along a pulley or gear system. Advantageously, the track system is adapted to move the moveable member to a location for receiving one or more packages. The dispensing apparatus includes one or more carriers for receiving one or more ingredient containers. Each carrier may comprise a single dispensing site or a plurality of dispensing sits. As such, the carrier may be adapted for rotational, linear or other forms of movement for locating one or more ingredient containers proximate to a dispensing site. The dispensing apparatus further includes a dispensing mechanism for dispensing of the ingredients from within the container into a package. Suitable dispensing devices includes any of the dispensing mechanism disclosed herein; however, most suitable dispensing mechanisms include electric valve system (e.g., servo mechanism, stepper motor or the like) or mechanical drive system (e.g., drive piston). Optionally, the dispensing apparatus may further comprise a means for placement of a package within the moveable member. Such means may include a cartridge adapted for releasing a package into the moveable member. Alternatively, or in conjunction therewith, the means may include a robot arm for placement of the package into the movable member. Similarly, a robot arm, or other means, may be adapted for placement of a cap, applicator (e.g., a brush or otherwise) or otherwise onto the container upon completion of dispensing into the package. Furthermore, a robot arm may be provided for presenting a final product to a user. While the ingredients may include any of the ingredient discussed herein, in preferred embodiment, the ingredients comprises a liquid component (e.g., a lip-gloss, foundation additive therefore or otherwise). Furthermore, it should be appreciated that the selected components to be dispensed into the package are based upon a formula of a selected customized cosmetic product as discussed herein or otherwise.

Figure 7A:
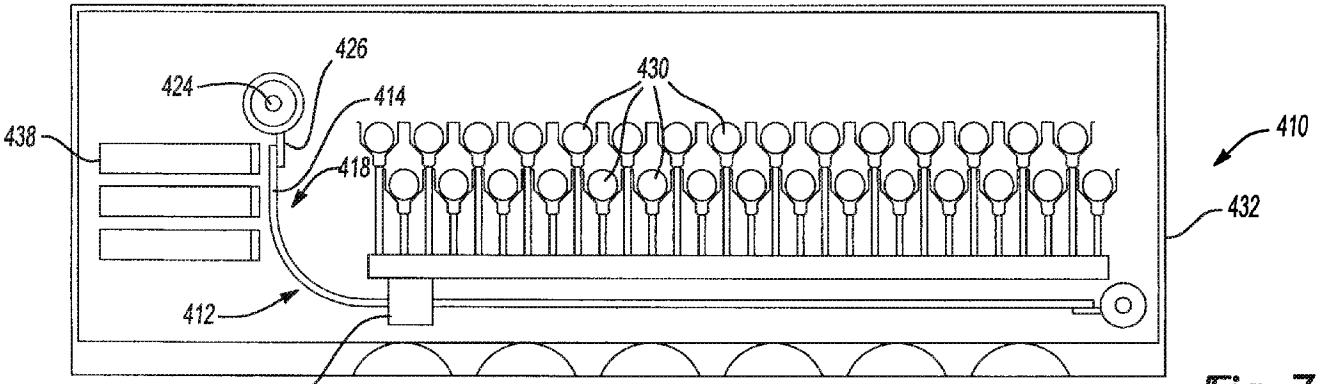
Figure 7B:
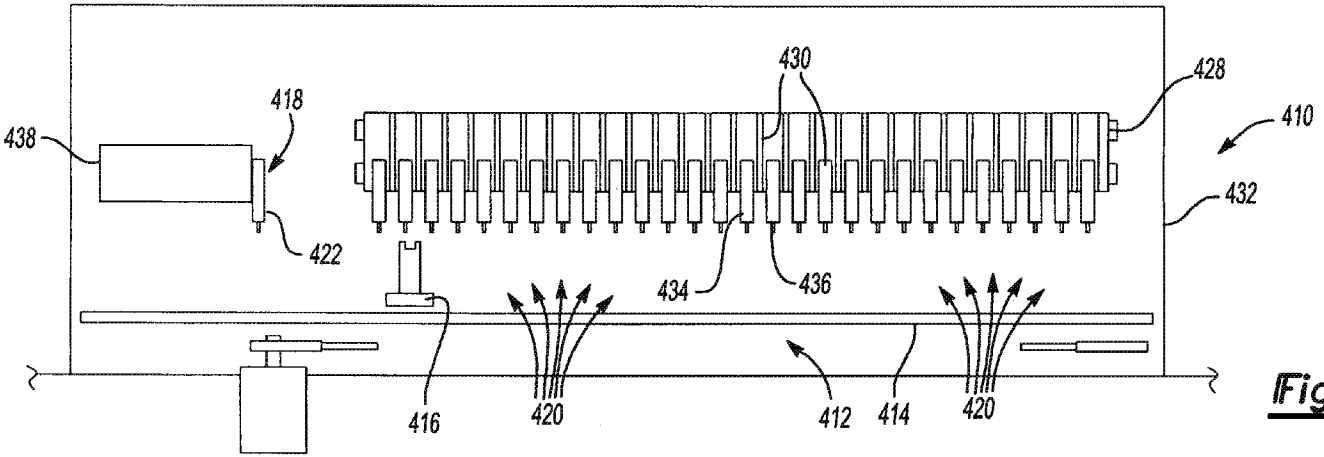
Figure 7C:
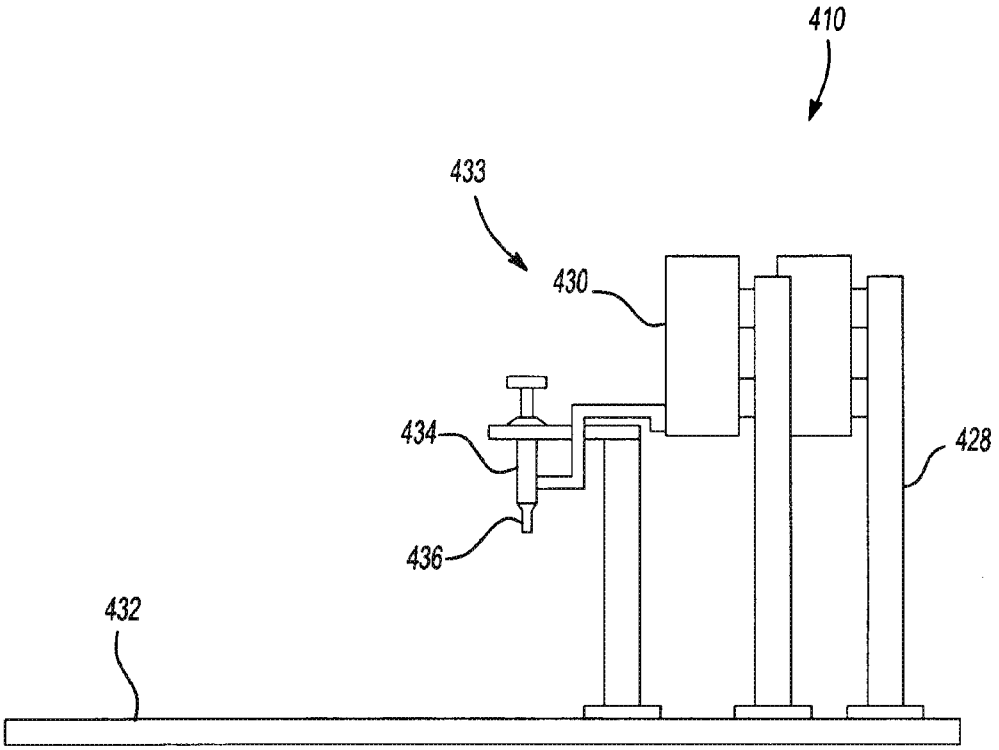
Figure 7D:
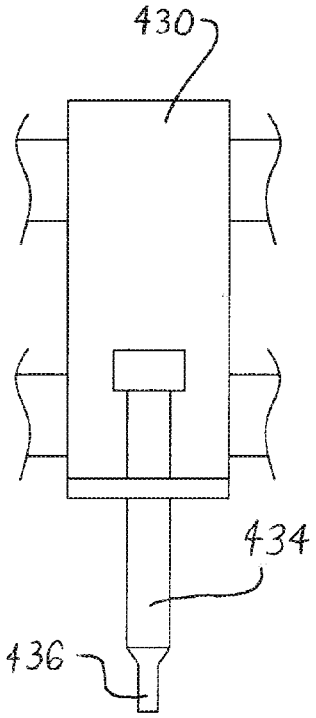

Referring to FIGS. 7A-B, a first example of a dispensing apparatus 410 having a track system 412 is illustrated. The track system includes a track 414 adapted to guide a moveable member 416, such as a nesting block, to a package pick up site 418 and to one or more dispensing sites 420, wherein the moveable member is adapted to hold and receive a package 422. Movement of the moveable block is achieved through a drive motor 424 and belt or chain 426, though other configurations are available. The apparatus further includes a carrier 428 adapted for receiving, or the mounting, of a plurality of ingredient containers 430. The carrier is preferably fixedly mounted to a housing 432. The dispensing apparatus is further configured with an electric valve system 433 in fluid communications with the ingredient container. As such, preferably the ingredient containers are in fluid communications with a servo mechanism or stepper motor or both and an electronic valve 434 having a nozzle 436 proximate to a dispensing site. Optionally, the servo may be activated to draw from the ingredient container, pour ingredients from the ingredient container and optionally prevent dripping of the ingredients. The apparatus further includes a second carrier 438 for holding a plurality of packages and optionally caps, applicators or otherwise. Optionally, a robot arm having a gripper for placement of the package into the moveable member is provided. The robot arm is adapted to grasp a package from the second carrier and place it into the movable member. Additionally, the root arm may be configured to install applicators, caps or otherwise into or onto the package and subsequently agitate the dispensed contents within the container for final presentation to a user. In operation, the moveable member moves or is otherwise positioned at the package pick-up site. The robot arm grasps a package and places the package within the moveable member. The moveable member is driven to one or more dispensing sites located below a nozzle, wherein ingredients are dispensed into the package. Upon completion of dispensing, the movable member is driven back to robot arm where optionally an applicator and cap are placed on or within the package. The robot arm then grasps the package and agitates the contents therein for presentation to the user. It should be appreciated that the functions of this embodiment may be automated based upon a user's selection of a customized cosmetic product.

Figure 8A:
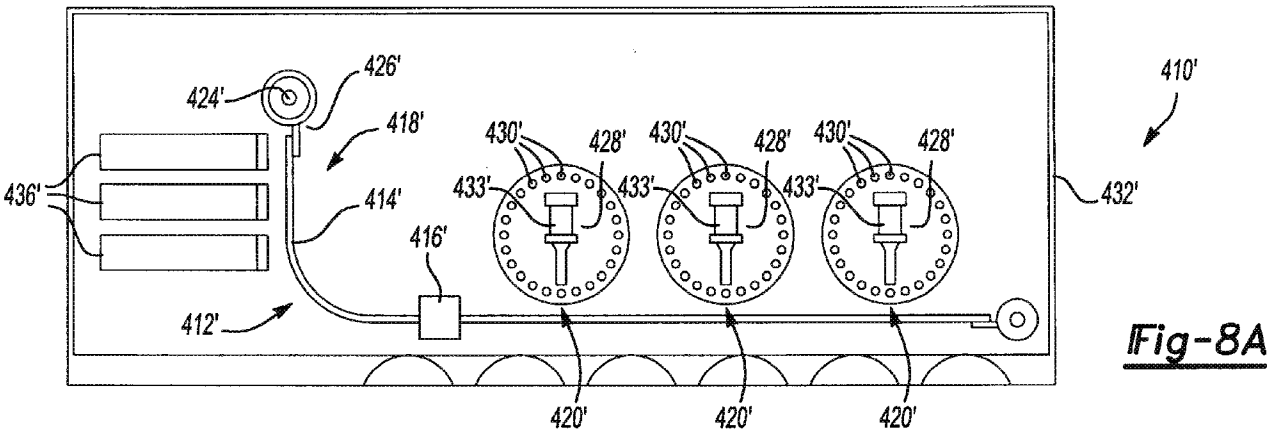
Figure 8B:
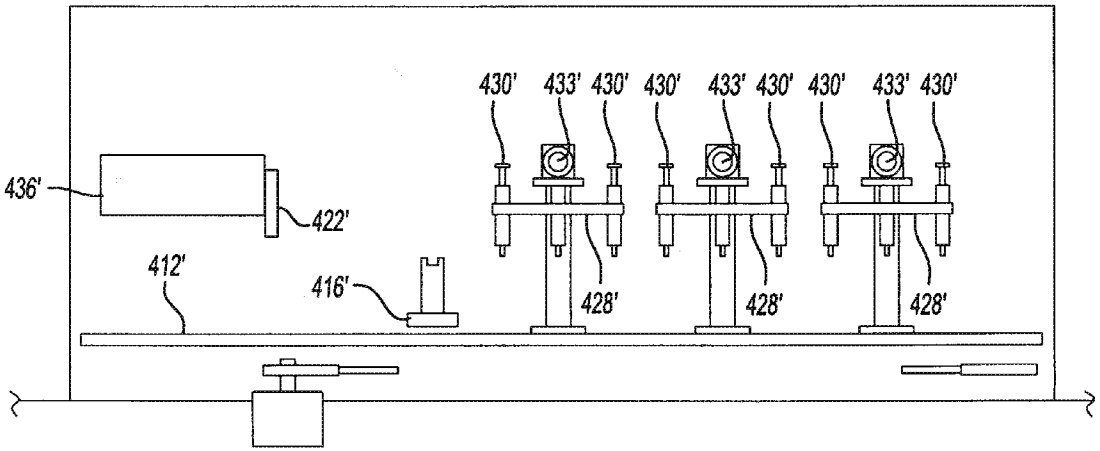

Referring to FIGS. 8A-B, another example of a dispensing apparatus 410' having a track system 412' is illustrated. The track system includes a track 414' adapted to guide a moveable member 416', such as a nesting block, to a package pick up site 418' and to one or more dispensing sites 420', wherein the moveable member is adapted to hold and receive a package 422'. Movement of the moveable block is achieved through a drive motor 424' and belt or chain 426', though other configurations are available. The apparatus further includes a carrier 428' adapted for radial mounting of a plurality of ingredient containers 430'. The carrier is preferably rotatably mounted to a housing 432' such that the plurality of container located thereon can be rotated to a dispensing site, via a suitable drive means. The dispensing apparatus is further configured with dispensing mechanism 433' for the dispensing of the ingredients from within the ingredient container. As such, preferably the ingredient containers are adapted for or otherwise configured for displacement of ingredients via a drive member such as a piston. The apparatus further includes a second carrier 436' for holding a plurality of packages and optionally caps, applicators or otherwise. Optionally, a robot arm having a gripper for placement of the package into the moveable member is provided. The robot arm is adapted to grasp a package from the second carrier and place it into the movable member. Additionally, the robot arm may be configured to install applicators, cap or otherwise into or onto the package and subsequently agitate the dispensed contents within the container for final presentation to a user. In operation, the moveable member moves or is otherwise positioned at the package pick-up site. The robot arm grasps a package and places the package within the moveable member. The moveable member is driven to one or more dispensing sites located below a nozzle, wherein upon rotation of the carrier to position a selected ingredient container over the dispensing site, ingredients are dispensed into the package. Upon completion of dispensing, the movable member is driven back to robot arm where optionally an applicator and cap are placed on or within the package. The robot arm then grasps the package and agitates the contents therein for presentation to the user. It should be appreciated that the functions of this embodiment may be automated based upon a user's selection of a customized cosmetic product.

The present invention further contemplates a mixer device including an electronically controlled magnetic actuator having at least one magnet adapted for moving an actuatable member contained within a container. The mixer device further includes a holder for receiving the container, the holder being operably associated with the electronically controlled actuator so that the actuatable member contained within the container, when held by the holder, positions the actuatable member in magnetic communication with the magnetic actuator for actuation of the actuatable member by the actuator.

In one aspect, the mixer is adapted for mixing contents within a package or other container, whether used in combination with a custom formulation dispenser (e.g., a rotary or other type of point of sale cosmetic dispenser) with some other dispenser, or independent of any dispenser. The contents may comprise of any suitable fluid ingredients as contained herein including powder or liquid ingredients. In one particularly advantageous application, the mixer may be used to mix resulting formulations as created by the custom dispensing device contained herein. Likewise, it should be appreciated that the mixer can also mix other formulation such as any formulation created by the dispensing device as found U.S. Pat. Nos. 6,412,658; 6,622,064, 6,672,341; 6,615,881; D465,810; D461,080; and D485,310 and Ser. No. 10/755,574 (filed Jan. 12, 2004), Ser. No. 10/437,085 (filed May 13, 2003), Ser. No. 10/848,273 (filed May 18, 2004), Ser. No. 10/274,514 (filed Oct. 18, 2002), Ser. No. 10/716,317 (filed Nov. 18, 2003); Ser. No. 29/192,696 (filed Oct. 28, 2003), 60/589,150 (filed Jul. 19, 2004). Accordingly, it should be appreciated that the mixer is adapted to agitate two or more ingredients, within a package, to form a single product, which may include pigmented fluids, effects (e.g., gloss, tints, glitter, etc.) or otherwise described herein.

Accordingly, it should be appreciated that the mixer of the present invention is adapted to be used with customized dispensing devices, as discussed or incorporated herein, wherein a user selects a customized product and ingredients are dispensed into a container corresponding to the selected product. Upon placement of the ingredients within the package, the mixer is adapted to mix the contents throughout so that the resulting product is substantially similar in color or effect as the product selected by the user. Accordingly, upon receipt of the customized product from the dispensing apparatus, the product can be immediately utilized without additional mixing or worrying about the consistency of the product.

The mixer of the present invention may be used independently of the dispensing system; however, advantageously the mixer is incorporated in the operation of an automated customized dispensing device. Accordingly, it should be appreciated that the mixer may be fixedly or movably mounted to a suitable structure for receiving a customized formula. Also, it should be appreciated that the location of the mixing may take place by moving the package to a mixer or moving the mixer to the package or a combination thereof. In one preferred configuration, the mixer is mounted to the dispensing device or is otherwise mounted at a fixed location, with respect to the dispensing device. For example, in dispensing configurations having a robot arm, translatable member or is otherwise configured with means for moving a package, the mixer is located within the movable spatial area or volume of the movable member. Accordingly, the mixer is in the reach of a dispensing member adapted to move a package throughout at least a portion of the operation of the dispensing device, wherein upon completion of mixing, the product can be presented directly to the user or otherwise is in condition for immediate application.

Alternatively, it should be appreciated that the mixture may be integrated or otherwise incorporated with the movable member, wherein the movable member is adapted to mix the ingredients within a package. Still further, it should be appreciated that the mixer may be slidably mounted to a member adapted for movement to one or more dispensing sites. Accordingly, the mixer may be driving to one or more dispensing sites wherein the ingredients from one or more ingredient packages are dispensed into a package and subsequently mixed by the mixer.

Suitable mixer of the present invention includes mixer adapted for agitation of the package, which inherently result in the mixture of any ingredients contained therein. Alternatively, a suitable mixer may be adapted for mixing the ingredients located in a package with substantially no movement of the package. Still further, a suitable mixer may include means for agitating the package and means for agitating the ingredients.

Accordingly, the mixer includes a seat for receiving a package from a moveable member associated with the dispensing device. The seat may be corresponding to the shape of the package or alternatively be configured with a gripping portion for holding the package. In either instance, preferably, the mixer is adapted to substantially prevent movement of the package, with respect to at least a portion of the mixer, during mixing of the ingredients.

In a first instance, the mixer may be adapted for three dimensional movement throughout a spatial area so as to impart a corresponding movement to the ingredients located within a package. The movement of the mixer may comprise a predetermined path, random path or a combination thereof. For example, the mixer may be adapted for movement along one or more axes within one or more coordinate systems, which may include horizontal and/or vertical movement, with respect to the dispensing system. Furthermore, the mixer may be adapted for rotational movement about any axes of the one or more coordinate systems. Still further, the mixer may be adapted for orbital movement, such as a centrifuge or otherwise. Of course, it should be appreciated that the movement may include combinations of axial, rotational or orbital movement. Example of suitable pattern movement includes three dimensional helical or double helical movement, oscillating movement, vibrational movement, rotational movement, orbital movement or otherwise. Accordingly, it should be appreciated that the movement of the mixer may be infinite. Also, the mixer of the present invention is not limited to these movements as other movement may be available.

Movement of the mixer may use any suitable drive mechanisms including mechanical, pneumatic, hydraulic, electrical, magnetic or otherwise. Accordingly, the mixer may include one or more belts or drive shafts translating power from a suitable drive mechanism.

Optionally, the mixer may further include means for further inducing mixing of the ingredient contained within the package. For example, referring again to the above first instance, the mixer may further include one or more translatable agitating members, located within package, which is adapted to move, with respect to the package, during movement of the package so as to further mix the contents located therein. The agitating members or the package optionally may be configured so as to prevent the agitating members from exiting the package during use of the contents, whether movement of the agitating member though contents of the container is achieved.

Suitable agitating members comprise members adapted for movement through fluid medium so as to cause agitation in the medium. For example, the agitating members may comprise one or more balls, bars, rods members (which may have a length equal to its diameter or the length of the inner volume of the package), or otherwise. The agitating members may have a slotted or hollow portion for reducing weight. The agitating members may also be suitably ornamented (e.g., with a reflective coating, a fluorescing agent, a colorant or otherwise) so as to provide an enhanced visual display of the mixing process (e.g., where the container is transparent). However, other agitating members may also be available including other symmetrical or non-symmetrical objects adapted to move within package. It should be appreciated that any of the agitating members may be configured to prevent the member from exiting the package during use of the contents therein.

In a preferred embodiment, the agitating members comprise a translatable magnetically actuatable member so as to be movable upon the application of magnetic field. Suitable magnetic field may be created from a magnetic component comprising electromagnetic force, a force originating from rare earth magnet material or otherwise having permanent or an assignable magnetic force, or some other magnetic field. Examples of suitable rare earth magnetic materials include Samarium Cobalt (SmCO), Neodymium Iron Boron, or otherwise. Accordingly, the mixer may be further configured with a magnetic component that is stationary during movement of the package, moveable along a portion of the exterior of the package or both.

The configuration of the magnetic component may vary between applications. However, preferably, the magnetic components are spatially located about the seat portion of the mixer so as to generate a magnetic field through at least a portion of any package located therein. Accordingly, the magnetic components may be radially disposed at least partially about the seat. Alternatively, or in conjunction therewith, the magnetic components may be stacked along a portion of the height of a package located within the seat. Advantageously, the stacked magnetic components may extend substantially the height of the package. It should be appreciated that numerous configurations are available, including magnetic components located below and above the package, to effectuate movement of any actuatable members located within a package. It should also be appreciated that the corresponding magnetic fields generated by the magnetic components may be perpendicular to a package or angled (e.g., up to 90 degrees), with respect to a perpendicular direction to the package.

Accordingly, suitable material that may be used as a translatable magnetically actuatable member, includes material that are substantially non-reactive and causes no appreciable degradation of the ingredients within the container. However, a preferred material is also is magnetically actuatable. For example, suitable materials include stainless steel such as an AISI 400 series stainless steel; preferably it is also a surgical grade stainless steel. Other stainless steels are useful as the actuating member material such as ferritic stainless steels or martensitic stainless steels. It may also be possible to use a highly worked austenitic stainless steel. Thus the actuating member may include nickel or be nickel free.

Movement of the package or the magnetic member, and hence the translatable magnetically actuatable member, may comprise a pattern or may be random. However, preferably the movement of the actuatable member is systematic so as to provide optimum patterns of movement for mixing the ingredients. A preferred systematic movement of the actuatable member comprises a three dimensional helical or double helical movement, which moves 360 degrees or more about the package. However, other patterns are available and within the scope of the present invention.

In another aspect of the mixer, the mixer may be substantially stationary during mixing of the ingredients within the package. In this configuration, the mixer is configured with one or more electromagnetic means for movement of one or more translatable magnetically actuatable members, as described above. Suitable electromagnetic means are activatable upon application of current therethrough. Accordingly, with the application of force, a magnetic field is generated for causing movement of the magnetically actuatable members located within the package. In a preferred configuration, a plurality of electromagnet means are positioned about the seat or gripping means of the mixer. Accordingly, movement of the actuatable members may be effectuated by a systematic application of current through the electromagnetic means.

Advantageously, the mixer includes or is otherwise in communication with a programmable logic controller, whether it comprises a separate component or is integrated with the controller (e.g., a solid state circuitry) as described herein, for facilitating in the application of current through the electromagnetic means. Accordingly, the movement of the actuatable member may comprise controllable movement including vertical, horizontal, rotation, orbital or other directional movement. Other systematic movement includes three dimensional helical or double helical movements. However, it should be appreciated that other movement is available and within the scope of the invention. For example, vibrational movement of the actuatable member may be effectuated through one or more pulses through one or more of the electromagnetic means. Accordingly, the actuatable members may be induced into preconfigured paths or patterns.

In view of the forgoing, FIGS. 10A-B illustrates a mixer device 500 that may be used in any of the dispensing device described or incorporated herein. The device includes a seat portion 502 adapted for receiving and holding a package 503 as described herein. It should be appreciated that the seat portion maybe comprised differing shapes to correspond to the shape of the package. Optionally, the mixer may include an attachment means 504 for mounting the mixer to the dispensing device or otherwise.

In the depicted mixer device, the mixer is adapted with one or more electromagnetic means 506 for movement of one or more translatable magnetically actuatable members 508. Preferably, the electromagnetic means are in communication with a programmable logic controller for the energizing of the means and application of one or more magnetic fields. Accordingly, the actuatable members are moved through the ingredients of the package to mix the contents therein.

Referring to FIGS. 11A through 13B, three additional exemplary embodiment of a dispensing apparatus of the present invention is shown. In these three embodiments, the dispensing apparatus includes any of the mixing devices as described herein. However, preferably the mixing device includes a magnetic actuation for mixing any contents located within a package. For example, as describe above, the mixer may include one or more magnetic device (e.g., electromagnetic or rare earth magnet) adapted for magnetically manipulating one or more magnetically actuatable members located within a package so as to mix the contents therein. Accordingly, the mixer may include a plurality of magnetic device located about a package seat portion. As previously discussed, this configuration may include movement no movement of the package or components of the mixer (e.g., electromagnetic application of force), movement of the magnetic components with respect to the package, movement of the package with respect to the magnetic components, combinations thereof. Of course, it should also be appreciated that other configurations are available, as described herein or otherwise.

Figure 11B:
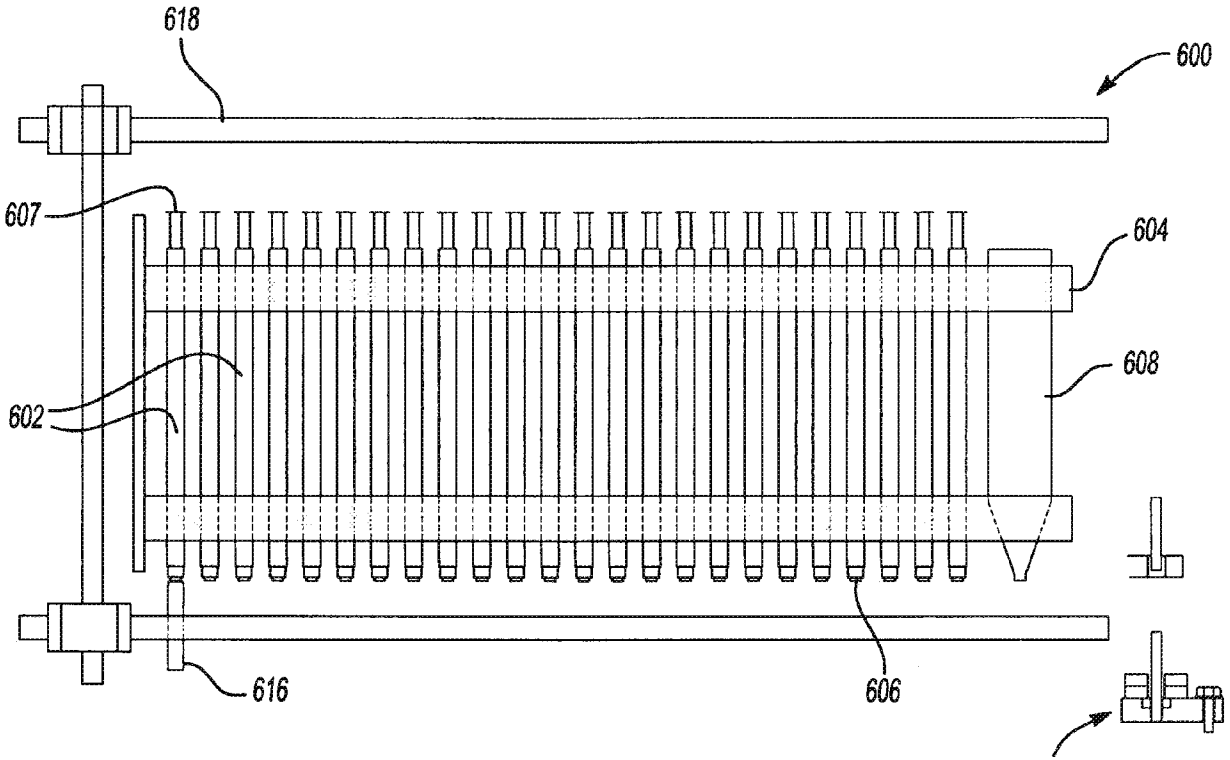
FIGS. 11A through 13B illustrate still other exemplary embodiments and/or features of a dispensing apparatus of the present invention having an exemplary mixing device.
Figure 11A:
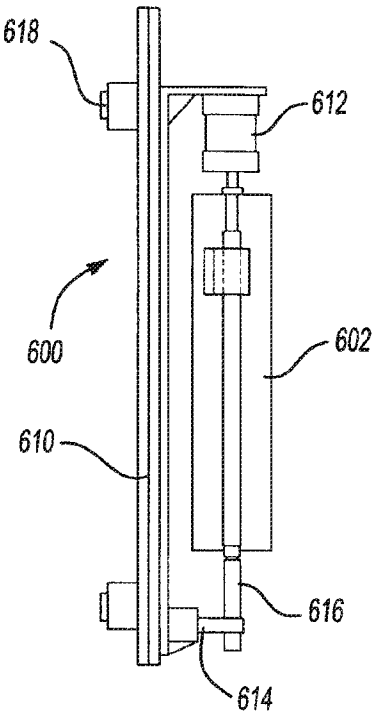

Referring to FIGS. 11A-B, a dispensing apparatus 600 is shown. The dispensing apparatus includes a plurality of ingredient containers 602 spatially located along a carrier 604. The ingredient containers are adapted to hold and dispense any of the ingredients contained herein, preferably through a nozzle portion 606. Advantageously, the ingredient containers includes syringe-like configuration or otherwise includes a plunger/piston configuration 607 adapted to be moved along an interior portion of the ingredient container to dispense ingredients therefrom and into a package.

Also located on the carrier, the apparatus further may include an actuatable ingredient container 608 having magnetically actuatable members for dispensing into a package. The actuatable ingredient container may include any suitable means for dispensing of the magnetically actuatable members such as valve configurations, syringe configurations or otherwise.

The dispensing apparatus further includes an actuator 610, having a C-shaped frame and tools, adapted for movement along an axis, wherein the actuator is adapted for applying a force against a plunger portion of the ingredient containers and carrying a package. Advantageously, the actuator includes a volumetric servo system 612 for movement of a plunger of the ingredient container. The actuator further includes a holder/gripper portion 614 adapted to hold a package 616 for receiving ingredients form the ingredient containers. Accordingly, preferably the holder/gripper portion is locate below the servo system and below the nozzles of the ingredient contains. However, the holder/gripper portion may also be vertically movable for facilitating in movement of the package.

Advantageously, the dispensing apparatus further includes one or more guide member 618 for guiding the actuator to one or more ingredient containers. Accordingly, upon movement of the actuator to an ingredient container, the server system is located over the plunger portion of the ingredient container and the holder/gripper portion of the package is located below the nozzle of the container such that upon movement of the plunger an proportionate amount of ingredients are dispensed from the ingredient container and into the package. It should be appreciated that this step may be repeated to create a customized formulation. Preferably, during dispensing of the ingredients, one or more magnetically actuatable members are also dispensed into the package, as described herein, when the package is placed below a dispensing site of the actuatable ingredient container.

Upon completion of the dispensing of ingredients, the actuator member moves the package to a mixer 620 and places the package in a seat portion of the mixer, wherein the mixer includes one or more magnetic component adapted to produce a magnetic field through a portion of the package. Accordingly, by manipulating the position of the magnetic components, packages, or current through the magnetic components, the magnetically actuatable components are caused to move through the ingredient to effectuate mixing of the same. It should be appreciated that movement of the actuator, mixing device or otherwise may be controlled by a suitable controller, which preferably includes a programmable logic control.

In one configuration of the embodiment shown in FIGS. 11A-B, the dispensing apparatus includes 24 ingredient containers, or vials, optionally including the following pigmentations or effects: 3 primary colors, black, white, 10 fines and 7 flavors. In one operation, though others are available, the cycle time of preparing a customized formulation comprises on average of 35 seconds for traversing and dispensing of 4 cosmetic ingredients and 25 seconds for mixing the formulation. It should be appreciated the present invention is adapted to provide infinite color variation. However, an anticipated range includes 20 to 200 color selection.

Figures 12A, 12B:
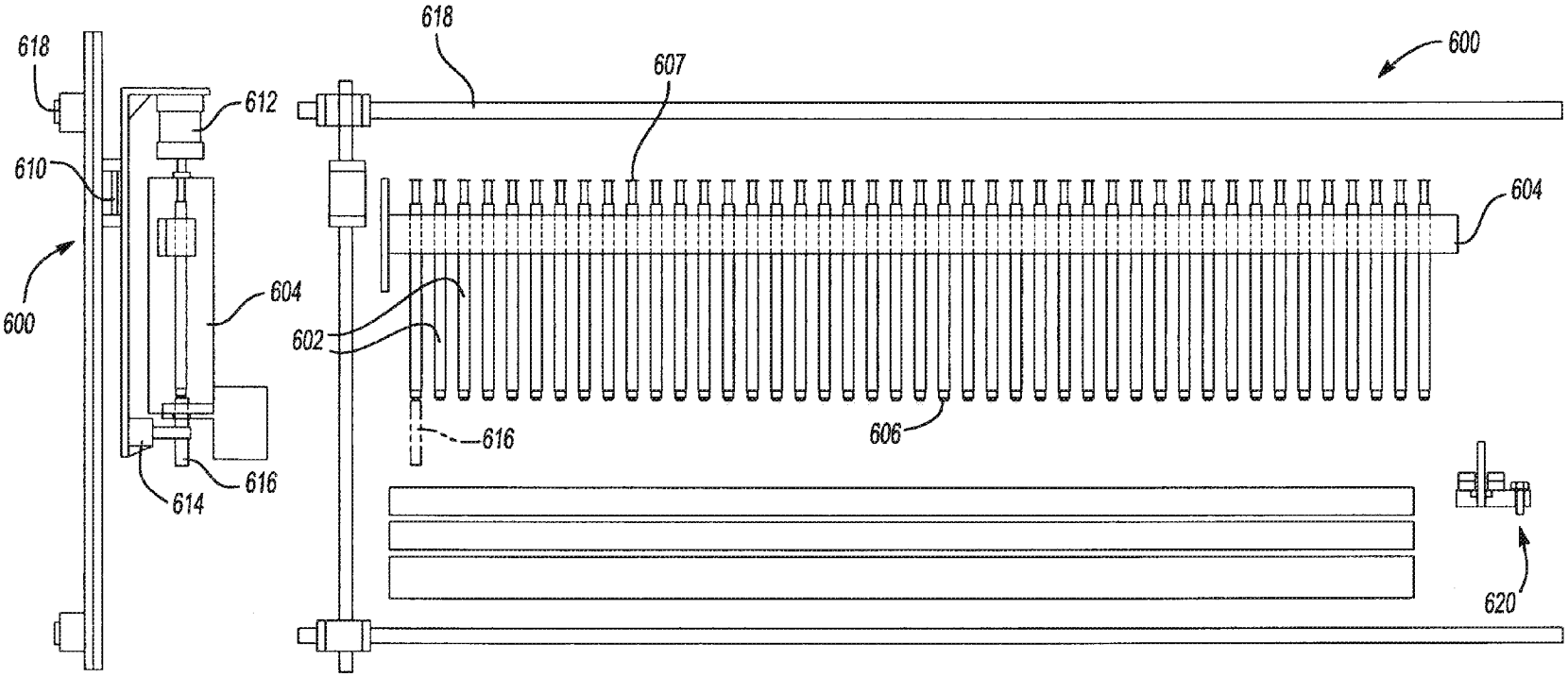

Referring to FIGS. 12A-B, another embodiment of the dispensing apparatus is shown, which comprises a variant to that of FIGS. 11A-B. In this configuration, the actuator operates in a similar fashion to FIGS. 11A-B and includes substantially the same components. However, this embodiment includes 30 ingredient containers having three times the volume capacity as other more conventional ingredient containers of dispensing devices and may include 18 colors, 7 finishes and 5 flavors. In one operation, the cycle time of preparing a customized formulation comprises on average of 35 seconds for traversing and dispensing of on average 2.7 cosmetic ingredients and 25 seconds for mixing the formulation.

Figure 13B:
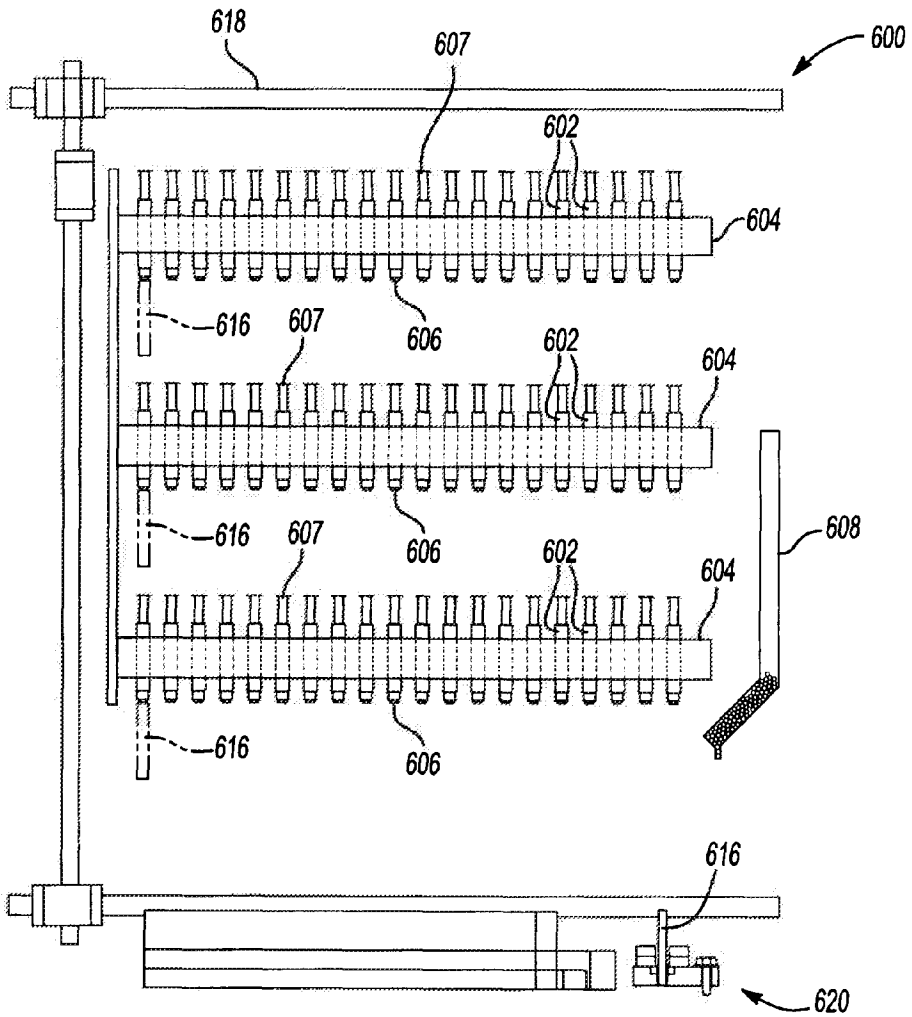
Figure 13A:
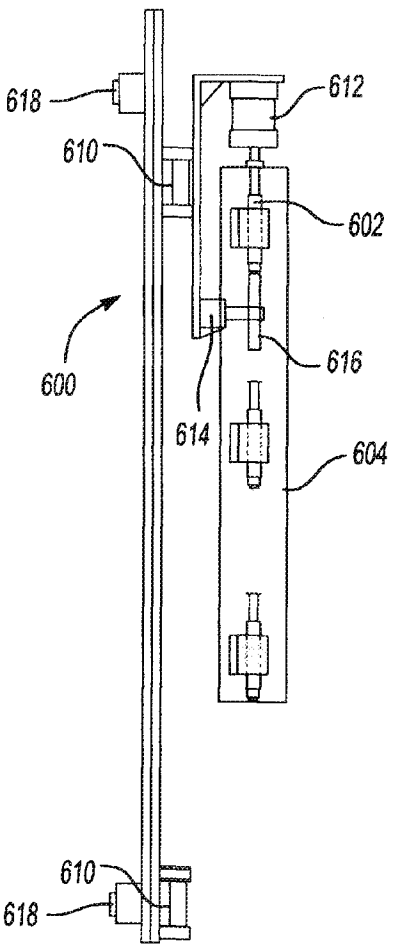

Referring to FIGS. 13A-B, another embodiment of the dispensing apparatus is shown, which comprises a variant to that of FIGS. 11A-B and 12A-B. In this configuration, the actuator operates in a similar fashion to FIGS. 11A-B and includes substantially the same components. However, in this configuration, a plurality of rows of ingredient containers is provided. Accordingly, the actuator is also adapted for vertical movement and horizontal movement so as to locate a package below the nozzle of an ingredient container and the volumetric servo system above the plunger of the same ingredient container. This embodiment includes 60 ingredient containers, or vials including 40 colors, 10 finishes and 7 flavors. In one operation, the cycle time of preparing a customized formulation comprises on average of 75 seconds for traversing and dispensing cosmetic ingredients and 25 seconds for mixing the formulation.

Figure 14:
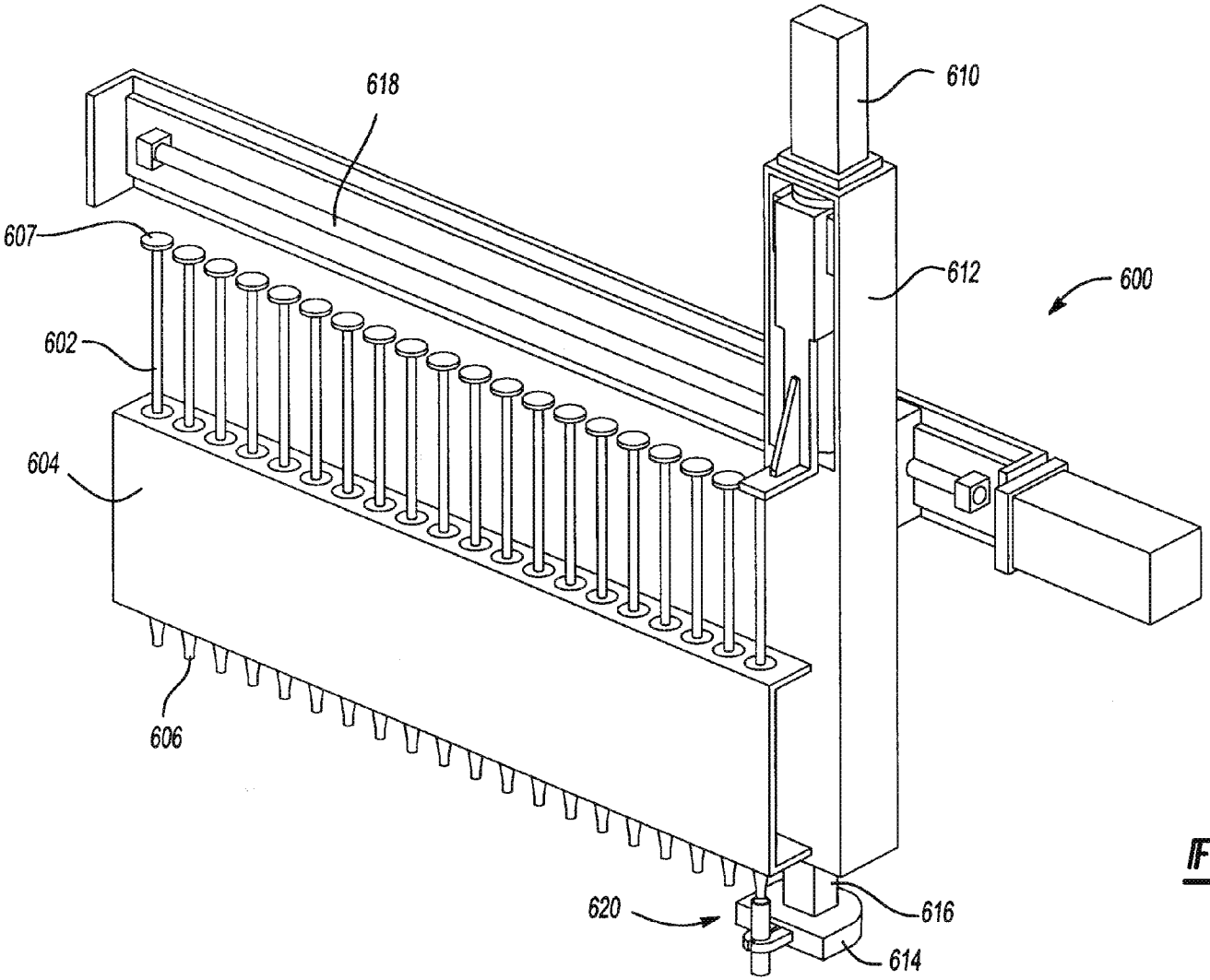
FIG. 14 illustrates yet another embodiment of the dispensing apparatus of the present invention.

Referring to FIG. 14, another embodiment of the dispensing apparatus is shown, similar to that of FIG. 12. In this configuration, the actuator operates in a similar fashion to FIG. 12 and includes substantially the same components. However, in this configuration, only one guide member is provided. It should be appreciated that the guide member, actuator or both may be adapted for vertical movement. It should also be appreciate, that this embodiment may include a mixer according to the teachings of the present invention.

It should be appreciated that the dispensing apparatuses, as contained herein, may be adapted for dispensing of ingredients in a manner different than what has been described thus far. For example, the dispensing apparatus may dispense in other types of packages than what was described thus far, may dispense ingredients without the use of packages (e.g., in a manner in which the customized product comprises the package) or otherwise. Accordingly, the dispensing apparatus is further configured with components for achieving alternate dispensing and presentation of a customized cosmetic product to a user.

In one aspect, it is contemplated that the dispensing mechanism dispenses the ingredients onto a porous article such as a patch, towelette, wipe or the like. Advantageously, a robot arm or otherwise may be used to grasp a towelette and place the towelette at a site for dispensing of ingredients to form a customized product. The ingredients are dispensed onto the towelette, according to the selection of a user, and provided thereto. Suitable towelettes and ingredients may be found in commonly owned U.S. Provisional Patent Application No. 60/589,150 (filed on Jul. 19, 2004) herein incorporated by reference. Resulting towelette products available with the present invention include: antibacterial towelette, moisturizing towelette, dental Bleaching towelette, hair removal towelette, bronzer towelette, body shimmer towelette, hair shimmer/color towelette, makeup remover towelette, nail polish remover towelette, acne treatment towelette, hair bleaching towelette, deodorant towelette, perfume towelette, sun protection towelette, exfoliation towelette or anti-aging towelette. Other resulting product include wipes having one or more cleansing agent thereon such as sanitary wipes or otherwise. These sanitary wipes may be used in numerous application including the cleansing of automobile, kitchens, bathrooms, hospitals or otherwise.

In another aspect, ingredients may be dispensed into a capsule, which may or may not be easily dissolvable. In such a configuration, a robot arm is configured to grasp one or more first portion of a container and place the container at a dispensing site, via a nest or otherwise. The container is then filled with one or more ingredients and a corresponding cap is placed over the first portion to form one or more capsules for presentation to a user. It should be appreciated that numerous capsules may be formed prior to presentation to the user and may include liquid ingredients, solid ingredients or both. While any ingredient may be placed in the container, suitable ingredients include dietary supplements, nutritional ingredients, medicinal ingredients or other beneficial health ingredients or otherwise. More specific examples of suitable ingredients include vitamins, herbs, oils, minerals, plant extracts, or other digestible materials that are advantageous to ones health.

In yet another aspect, the ingredients may be dispensed into a mold for forming a unitary structure such as a bar, tablet, or otherwise. For example, a mold may be placed at a dispensing site for receiving one or more ingredients from the ingredient containers. Upon dispensing of the ingredients a corresponding mold portion is joined to compress the ingredients and form a unitary structure. It should be appreciated that other suitable molding configurations are available. Advantageously, a robot arm may be used to manipulate the mold components and present the resulting product to the user.

In another application of the robot arm or other movable member, the arm may be adapted to provide maintenance of the dispensing apparatus. For example, one or more arms may be adapted for replacement of ingredient containers, nozzles, syringes or other components of the dispensing apparatus. Accordingly, the dispenser may be configured with suitable tools, if necessary, for the removal of these components. It should be appreciated that the robot arm is programmably adapted to multi-task, in other words, the robot arm may be configured to perform a plurality of functions simultaneously.

In any of the examples contained herein, it should be appreciated that a user interface may be provided for placement of a customized product order and preferably a customized cosmetic product. The user interface may be proximate to the dispensing apparatus or it may be remotely located (via the Internet). Upon selection of a customized product, the product information is communicated to the control unit, which includes information pertaining to the formula of the selected customized product. Upon receipt of the formula, the controller controls the dispensing apparatus to dispense the ingredients from within the ingredient containers and into a package. The control, operation and dispensing of the dispensing apparatus is substantially free from assistance from a technician.

Accordingly, the dispensing apparatus is adapted to receive customized product orders at anytime of the day, optionally in the absence of a technician. As such, in one aspect, one or more dispensing apparatus may be regionally located to receive one or more orders, such as over the Internet, through a user interface or otherwise. Upon placement of a customized order, a formulation is transmitted to the dispensing apparatus, and preferably a dispensing apparatus that is located close to the user. Upon receipt of the formulation, the dispensing apparatus dispensing the ingredients according to the specification of the user, which may or may not include placement of the ingredients into a package as discussed herein. The resulting customized product(s) are then place together and preferably remote from the dispenser such that the dispenser can fulfill other customized product order. It should be appreciated that the dispensing apparatus is adapted to keep the orders separate such as by placing the fulfilled order in bins, on conveyer belts or otherwise. Periodically, and preferably at least once a day, the customized products are assembled and shipped to the user. Optionally, the dispensing apparatus may be further adapted to further distinguish the resulting customized product by placement of a label, invoice, media device or otherwise, which preferably includes information pertaining to the dispensed product, user or both.

In another configuration, dispensing apparatus is adapted to receive orders of customized products during non-business hours (e.g., between 6 pm to 10 am, 8 pm to 8 am, 10 pm to 6 am or otherwise) with respect to the user placing the order. In such a configuration, an order may be placed during non-business hours using a user interface (e.g., a computer, telephone system, Radio Frequency Identification Device interface, other media interfaces, or otherwise). Upon placement of the order, a formulation is transmitted to a dispensing apparatus, which preferably is located in the same region as the user (e.g., the same time zone or otherwise), wherein the dispensing device dispenses a customized product into a package, in accordance with the formula, during non-business hours and wherein the finalized product is made available to the user during the business hours of the following day. Preferably, the dispensing device is located within about 200 miles of the user, more preferably within about 100 mile of the user, still more preferably within about 50 miles of the user and still more preferably within about 25 miles of the user. It should be appreciated that the making available of the finalized package to the user may include: storage of the package at a site for pickup by the user, delivery of the package to the user (e.g., via mail, Federal Express, or otherwise), delivery of the package to a storage facility located in an area close to the user, or otherwise.

Alternatively, the order may be made during non-business hours, as discussed above, and received at a point-of-sale facility having a dispensing apparatus according to the present invention. The dispensing device then creates the customized product prior to, or during, the business hours of the following day such that it can be picked up by the user. Other configurations should be appreciated are within the teachings of the present invention.

In yet another configuration, the user interface may comprise or include a data interface adapted to receive information pertaining to a customized product or otherwise. Suitable interfaces include disc drives, ScanDisc, Compact Flash, MicroDrive, Smart Media Card, MultiMedia Card, Memory Stick, Secure Digital Card, Radio Frequency Identification (RFID), or other type of media interfaces for the accessing of information on a removable storage device. Similarly, the user interface may also be used for storing information relating to a selected customized cosmetic product or otherwise.

In a preferred embodiment, an RFID system is adapted to interface between a dispensing apparatus of the present invention and a user thereof so as to store and record information, for subsequent retrieval by the user, relating to dispensed products from the dispensing apparatus, or as otherwise described herein. As such, in one aspect, the RFID system comprises a transponder, preferably in communications with the dispensing apparatus, and a corresponding transponder badge adapted to be kept by a user. In such a configuration, the transponder is adapted to transmit a signal to the badge for energizing the badge so that information stored on the badge can be communicated to the transponder. As previously discussed, this information may be related to the users health, user dispensing history, combination thereof or otherwise. Upon selection of a product, the transponder subsequently transmit a signal to the badge to update the history of dispensed products or otherwise. It should be appreciated that the information stored on the badge may be viewable through a user interface, on a monitor associated with the dispensing device, or otherwise. Suitable RFID systems that may be used with the present invention include RFID systems found in U.S. Pat. Nos. 5,629,981, 6,172,596 and 6,121,878 herein incorporated by reference.

The use of a robot arm of lesser or higher degrees of freedom may be substituted as desired in any of the embodiments contained herein (e.g., a three axis for a two axis, a four axis or even a six axis for a two or a three axis, combinations thereof or otherwise). Also, the number of robot arms for each embodiment may vary. Furthermore, the arrangement and orientation of ingredient containers may vary to what has been described in the embodiment contained herein. For example, it should be appreciated that embodiment comprising radially disposed ingredients containers may alternately comprise linearly disposed ingredient containers or other configurations including random configuration, systematic configuration or otherwise. Furthermore, it should be appreciated that any of the robot arms contained herein may translate a platform, an ingredients container, a package into which ingredients are dispensed or any combination thereof.

As should be appreciated from the embodiments contained therein, the following are among some of the ways in which the dispensing device, including robot arm, may be configured to function providing one or more fixedly located ingredient containers and packages wherein the robot arm or otherwise moves to the one or more ingredient containers to withdrawal ingredients therefrom (via through aspiration or otherwise) and dispense the ingredients withdrawn into the package; fixedly locating a package at a dispensing site (though it should be appreciated that the package may be subsequently moved) and movably locating one or more ingredient containers proximate to the dispensing device and dispensing ingredients located in at least one of the one or more ingredient containers into the package; fixedly locating one or more ingredient containers, each ingredient container being located at a dispensing site, and moving a package to at least one of the dispensing site for receiving ingredients from the package located thereat; or combinations of any of the above configurations; or otherwise.

In view of the foregoing discussion, the present invention provides an automated custom cosmetic dispensing device and method that is adapted for dispensing of a customized cosmetic product with little to no assistant from a technician. As such, it should be appreciated that the present invention allows for the independent filling of customized cosmetic orders with little to no operator intervention.

In a particular aspect, the present invention is employed in a retail mass merchandising outlet environment, such as a grocery store, a department store (Target™, Wal-mart™, etc.), a warehouse club (e.g. Sam's Club™, Costco™, etc.), a mini-mart (e.g., 7-11™, Mobil Mart™, etc.), or any combination thereof. In this regard, it is contemplated that the apparatus of the present invention will be incorporated into a unit that occupies less than about 5 $m^3$, less than 3 $m^3$, or even less than 1 $m^3$. The unit may include shelving, a display panel, a concealed storage compartment for holding items such as replacement inventory. One or more transparent panels for viewing moving components during dispensing, one or more opaque panels, or a combination thereof. Preferably, the visible components of the dispensing apparatus will be at a height of about 1 m to about 2 m above ground level, so that during dispensing a customer will be able to view the dispensing operation. Though a variety of configurations are possible, one approach is that the dispensing apparatus is a substantially enclosed unit for housing its computer, its user interface, the robot arm and the ingredients containers, and is capable of placement on existing shelving or a display unit within a retail mass merchandising outlet without substantial modification of the shelving or display unit of the outlet. For example, the unit may comprise a generally rectangular housing (e.g., a box-like structure having a dimension of about 0.3 to about 1 m long by about 0.3 to about 1 m deep, by about 0.3 to about 1 m tall. The unit may contain its own power source or may be wired for connection with an external power source.

Also contemplated as within the scope of the present invention are methods of doing business, wherein a point of sale customization of a product, such as a consumer product (e.g., a solid or liquid cosmetic formulation) is performed by a machine that also engages a customer by entertaining the customer during product customization. Effectively, the enjoyment from observation of the machine in operation serves to soothe the customer, invite the customer to purchase additional product located proximate the machine or both. Such engagement may be accomplished in any of a number or different ways, and in a particular aspect, it involves appealing to at least two of a customers senses (e.g., combinations of two or more of sound, sight, taste, smell, or touch). For example, it is possible that music may play, audio tones are emitted, a soothing voice recording speaks, a video image is displayed, an aroma is emitted, the internal operations of the machine are displayed, a heating or cooling sensation is created, or any combination thereof during the product customization process. It is also possible that steps of operation of the machine are synchronized with one of the sense appealing mechanisms. For example, an audio tone, music or both is emitted while a robot arm or other movable component is in motion.

Accordingly, in specific aspect, the dispensing apparatus may included or be associated with a sound system for providing music or sounds for the user of a customized cosmetic dispensing device at a retail point-of-sale. Alternatively, the music may be provided at a user interface of a customized cosmetic dispensing device (e.g., a user interface attached or associated with the dispensing device or a user interface remote from the dispensing device via a network, Internet or otherwise). The sound effects or music may be continuously played, played in response to selection made by the user at a user interface, played to attract patrons to the dispensing apparatus, combinations thereof or otherwise.

In another specific aspect, the dispensing apparatus may also include aromas integrated or dispensed about the dispensing device. The aroma may comprise a continuous fragrance typically enjoyed by patrons of customized cosmetic protects. Suitable fragrances includes natural fragrances (e.g., floral, fruit, spices, or otherwise) or man-made fragrances (e.g., perfume, body spray or otherwise). Optionally, the fragrance may comprise a fragrance selected by the user, at a user interface or otherwise, for possible integration with the customized cosmetic product.

Advantageously, the present invention may also be provided in a kit form for supplying the above identified retailers with a point of sale cosmetic selection and dispensing apparatus. For example, a kit may be purchased by these retailers, which includes a dispensing apparatus, a plurality of ingredient container optionally having ingredients therein, and a plurality of packages. Additional kits, which may be purchase with the original kit or subsequently, may include additional packages, ingredient containers or a combination thereof or otherwise. Other products that may be included with the original kit, or otherwise, may include components associated with the selected cosmetic product. For example, the kit may further include brushes, mirrors, cosmetic pencils, bags, identification tags, media devices for storage of a selected product, other cosmetic products previously formed or otherwise. As such, the dispensing apparatus may further be adapted for vending of product other than a customized cosmetic product.

In view of the foregoing, a retail facility may place an order for the kit for providing a point of sale custom cosmetic dispensing device for its consumers. The kit can be conveniently located at any location throughout the retail facility, including a checkout line. Upon noticing of the dispensing apparatus, the user can select and receive a customized cosmetic product with no or only insubstantial technician assistance (thus obviating the need to hire personnel dedicated to the operation and maintenance of the device). Not only is this configuration easy to use for the end user, but is also fun to watch and use in view of the different ingredients colors, operation of the dispensing mechanism and robot arm, and transparent configuration of the housing, among other features.

The examples illustrated herein are not intended as foreclosing other alternative approaches. They also do not necessarily require the employment in each instance of all of the disclosed features. For example, it is possible that the example illustrated in FIGS. 4A-D, may omit the feature of a rotary nest and alternatively dispense the ingredients in the container while being held by the robot arm. In the example of FIGS. 4A-D, that might omit the features of a second carrier for holding a plurality of packages. Alternatively, it is possible that components are added to the embodiments of the present invention. For example, it is possible that the example illustrated in FIGS. 5A-D may further comprise a second carrier for holding a plurality of packages or associated components. Other configurations are possible and within the scope of the present invention.

Unless stated otherwise, dimensions and geometries of the various structures depicted herein are not intended to be restrictive of the invention, and other dimensions or geometries are possible. Plural structural components can be provided by a single integrated structure. Alternatively, a single integrated structure might be divided into separate plural components. In addition, while a feature of the present invention may have been described in the context of only some of the illustrated embodiments, such feature may be combined with one or more other features of other embodiments, for any given application. It will also be appreciated from the above that the fabrication of the unique structures herein and the operation thereof also constitute methods in accordance with the present invention.

The preferred embodiment of the present invention has been disclosed. A person of ordinary skill in the art would realize however, that certain modifications would come within the teachings of this invention. Therefore, the following claims should be studied to determine the true scope and content of the invention.

What is claimed is:

1. A method for dispensing a custom formulation comprising the steps of:

providing a custom formulation dispensing system, including a plurality of ingredient containers containing one or more ingredients located on at least one carrier and a plurality of porous articles for dispensing thereon;

recommending of ingredients to be dispensed from the dispensing system based upon stored information in one or more information retrieval devices, wherein the stored information optionally is related to a user;

dispensing at least one of a plurality of user selected custom formulations onto at least one porous article with the dispensing system; and wherein the custom formulation dispensing system includes a computer, an automated dispensing apparatus for dispensing ingredients from the plurality of ingredient containers using an at least two-axis robot arm, and a housing; and wherein the housing contains at least two of the following: the computer, the automated dispensing apparatus, and the plurality of ingredient containers.

2. The method of claim 1, wherein dispensing takes place in a substantial absence of a technician for operating the dispensing apparatus.

3. The method of claim 1, wherein the at least two-axis robot arm is translatable in at least an X and Y direction and is rotatable about a Z axis.

4. The method of claim 1, wherein the at least two-axis robot arm is translatable in at least one of an X, Y and Z axis and is rotatable in at least one of an X, Y and Z axis.

5. The method of claim 1, wherein the at least two-axis robot arm is translatable in at least two of an X, Y and Z axis and rotatable in at least two of an X, Y and Z axis.

6. The method of claim 1, wherein the at least two-axis robot arm translates a platform, an ingredient container, an article onto which ingredients are dispensed or any combination thereof.

7. The method of claim 1, further comprising a step of employing a radiofrequency identification device for retrieving information about a customer, for monitoring inventory, for controlling operation of the at least two-axis robot arm or any combination thereof.

8. The method of claim 1, wherein the dispensing apparatus is provided with a transparent portion in its housing to allow for viewing of dispensing.

9. The method of claim 1, including a step of sensing an amount of ingredients in one or more of the plurality of ingredient containers via sensors and wherein the sensors include position sensors, weight sensors, pressure sensors, and any combination thereof.

10. The method of claim 1, wherein the dispensing system includes a data interface adapted to receive information pertaining to a customized product or information pertaining to a user's health and/or beauty needs or purchase history.

11. The method of claim 1, wherein the at least two-axis robot arm is configured to actuate expulsion of the one or more ingredients through an orifice of the ingredient container onto the porous article.

12. The method of claim 1, wherein a pressure and valve system is used to pressurize the ingredient container and urge the one or more ingredients from within the ingredient container through an associated nozzle.

13. The method of claim 1, wherein the plurality of ingredient containers include bags, cartridges, bottles, vials, tubes, barrels, wells in a block of material, cans, or any combination thereof.

14. The method of claim 1, wherein the at least two-axis robot arm is programmed to locate a proper location and/or cause dispensing from the plurality of ingredient containers.

15. The method of claim 1, wherein the porous article is a patch, towelette, or wipe.

16. The method of claim 15, wherein the porous article is a towelette.

17. The method of claim 1, wherein the at least two-axis robot arm is configured to grasp a towelette and place the towelette at a site for dispensing of ingredients to form a customized product.

18. The method of claim 1, wherein a user interface is located remote to the dispensing system and connected to the dispensing system via internet.

19. The method of claim 1, wherein a user interface is located in or on the housing to form a self-contained structure.

20. The method of claim 1, wherein the housing is sized to rest on or within a counter top or in a display.

* * * * *